US007431323B2

(12) United States Patent
Holzer et al.

(10) Patent No.: US 7,431,323 B2
(45) Date of Patent: Oct. 7, 2008

(54) CONNECTING DEVICE BETWEEN A BOOT AND A BOARD-LIKE TYPE OF SPORTS EQUIPMENT, PARTICULARLY A SKI BINDING

(75) Inventors: Helmut Holzer, St. Johann (AT); Franz Resch, Schladming (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 467 days.

(21) Appl. No.: 11/325,387

(22) Filed: Jan. 4, 2006

(65) Prior Publication Data

US 2006/0145455 A1 Jul. 6, 2006

(30) Foreign Application Priority Data

Jan. 4, 2005 (AT) ..... A 11/2005

(51) Int. Cl.
*A63C 9/18* (2006.01)

(52) U.S. Cl. ..... 280/625; 280/623; 280/611; 280/11.3; 280/841; 280/607; 280/613

(58) Field of Classification Search ..... 280/625, 280/623, 611, 11.3, 841, 607, 613
See application file for complete search history.

(56) References Cited

U.S. PATENT DOCUMENTS 3,563,561 A 2/1971 Mottet
3,584,891 A * 6/1971 Khazzam ..... 280/625
3,877,711 A * 4/1975 Koehler ..... 280/630
4,480,850 A * 11/1984 Schneider ..... 280/630
5,180,183 A * 1/1993 Bogner ..... 280/629
7,207,591 B2 * 4/2007 Riedel et al. ..... 280/614

FOREIGN PATENT DOCUMENTS

AT 321796 6/1972
DE 1703998 8/1968

(Continued)

*Primary Examiner*—Christopher Ellis
*Assistant Examiner*—Cynthia F. Collado
(74) *Attorney, Agent, or Firm*—Collard & Roe, P.C.

(57) ABSTRACT

The invention relates to a connecting device (1) between a boot (2) and a board-like type of sports equipment (3), in particular a ski binding. The connecting device comprises a toe or front binding fixture (5) that can be associated with the tip (4) of the boot, and a heel or rear binding fixture (7) that can be associated with the heel area (6) the boot (2). The binding fixtures each have a sole holder (8,9) for engaging the boot (2). The boot is clamped between the sole holders with a pre-tensioning force that is applicable via a pre-tensioning spring (11). A release device (12,13) for the sole holder (8,9) is arranged between the sole holder (8,9) and a bearing block (14,15) of the toe and heel binding fixtures (5,7), and provision is made for a joint arrangement for rotationally supporting the sole holder (8,9) and the bearing block (14, 15), the latter being arranged fixed on the ski, in relation to one another in at least two three-dimensional directions extending perpendicularly to each other, whereof one direction is aligned vertically to a support surface (50) supporting the bearing block (14,15) on the board-like type of sports equipment (3). The joint arrangement disposed between the bearing block (14,15) and the sole holder (8,9) or at least one sole holder component (24,25), is formed by at least one ball-and-socket joint (26, 27, 101).

44 Claims, 13 Drawing Sheets

FOREIGN PATENT DOCUMENTS

| | | |
|---|---|---|
| DE | 1804181 | 10/1968 |
| DE | 2136262 | 7/1971 |
| DE | 2206141 | 2/1972 |
| DE | 2220560 | 4/1973 |

* cited by examiner

CONNECTING DEVICE BETWEEN A BOOT AND A BOARD-LIKE TYPE OF SPORTS EQUIPMENT, PARTICULARLY A SKI BINDING

CROSS REFERENCE TO RELATED APPLICATIONS

Applicant claims priority under 35 U.S.C. §119 of AUSTRIAN Patent Application No. A 11/2005 filed on Jan. 4, 2005.

BACKGROUND OF THE INVENTION

1. Field of the Invention

The invention relates to a connecting device between a ski boot and a board-like type of sports equipment, in particular a ski binding, comprising a toe or front binding fixture associable with the tip of the ski boot, and a heel or rear binding fixture associable with the heel of the ski boot. Said binding fixtures each have a boot sole holder adapted for engaging the ski boot, whereby the ski boot is chucked between said binding fixtures with an initial clamping force applicable via a pre-tensioning spring, and a release device for releasing the sole holder of the ski boot that is arranged between the ski boot holder and a bearing block supporting the toe binding fixture, and a bearing block supporting the heel binding fixture; as well as a joint arrangement disposed between the boot sole holder and the bearing block, the latter being fixed on the ski, for rotationally supporting said binding fixtures in relation to one another, permitting their rotation in at least two directions extending vertically relative to each other, with one of said directions being aligned perpendicularly to a support surface of the bearing block for supporting the latter on the board-like type of sports equipment.

2. The Prior Art

Such a connecting device is usually comprised of a toe binding fixture associated with the tip of the ski boot disposed in front of the latter, and a heel binding fixture associated with the heel of the ski boot, in a manner known, for example from DE 21 36 262. The toe and heel binding fixtures may comprise ski boot sole holders adapted for engaging the ski boot. The boot is normally clamped between said toe and heel binding fixtures and the boot sole holders with an initial clamping force. For releasing the boot from such a board-like type of sports equipment, an actuation device has to be actuated for releasing the pre-clamping device and thus canceling the initial clamping force, so that the boot can be lifted off from the board-like type of sports equipment. The boot sole holders are additionally equipped with a pre-tensioning spring of a release device disposed in a central position relative to the bearing blocks of the toe and heel binding fixtures. The initial tensioning force of the spring can be adjusted as required depending on the skiing skills of the skier, as well as based on criteria adapted to the user of the ski binding such as his or her weight, age, and skiing skills, and, for example, the diameter of the tibia, the objective to be accomplished being that when such a connecting device exerts stress on the foot of the skier while the latter is skiing with such a type of board-like sports equipment, such stress will not reach a magnitude or level of strain so high that it might lead to injury to the skier. The purpose is rather to overcome the initial stressing force exerted by the pre-tensioning spring before such a level of strain is reached, so that the ski sole holder will be released, and the boot is enabled to detach itself from the board-like type of sports equipment before the foot of the skier suffers any injury. In conjunction with a joint arrangement that is used with the known toe binding fixture, a ball and a spherical indentation-like recess associated with the latter are adapted for pivoting relative to one another in a plane extending parallel to the surface on which the bearing block is mounted. This permits a relative adjustment between the ball and the deepening in one three-dimensional direction. Moreover, in a preferred way, it is possible as well to adjust the ball and the recess relative to one another in another three-dimensional direction, specifically in the direction extending perpendicularly to said plane, so that when the toe binding fixture moves in the vertical direction relative to the stand-on surface, the boot is released by the sole holder if a pre-adjustable force is exceeded. Such an embodiment is disadvantageous in that the ball is a component of the release device, forming one structural unit jointly with the latter, and that is it therefore not possible to achieve either any exact guidance of the sole holder relative to the bearing block, or any exact release or precise prior determination of the release values for the toe binding fixture. In addition, it is a drawback that the sole holder has to be fastened on the ski boot separately.

Furthermore, it is also known already from DE 22 20 560 C3 to employ a connecting device, particularly a toe binding fixture for a safety ski binding, in conjunction with which the sole holder is adapted for pivoting on a pivotal axle that is stationarily arranged in the bearing block, and aligned vertically to the surface on which said bearing block is set up, whereby the sole holder is held via a release device formed by a ball that is pressed into a ball socket-type recess via the initial tension of a spring. In the present case, the entire sole holding device is arranged on the toe binding fixture, and no structural alterations and mounting work are required on the ski boot, on the one hand. However, on the other hand, the sole holder can be exactly pivoted around the stationary, vertical pivotal axle in only one plane.

SUMMARY OF THE INVENTION

The present invention is based on the problem of providing in conjunction with a connecting device between a ski boot and a board-like type of sports equipment a toe or front binding fixture that permits simple and exact guidance of the sole holder vis-à-vis the stationary part of the toe binding fixture, particularly the bearing block, for allowing in this way an exact adjustment of the initial tensioning and release or uncoupling values.

The problem of the invention is resolved in that a joint arrangement disposed between the bearing block and the sole holder, or at least a part of the sole holder is formed by at least one ball-and-socket joint. By virtue of the fact that provision is now made for a ball-and-socket joint that exclusively serves the purpose of guiding the sole holder of the toe binding fixture, and for supporting the latter in all three 3-dimensional directions, exact guidance with low tolerance is now made possible with low expenditure in several three-dimensional directions extending at an angle in relation to one another. Owing to the central mounting and guidance of the sole holder for permitting mobility in a number of three-dimensional directions, the mechanical expenditure can be reduced, and, furthermore, the friction conditions or the inherent resistance occurring in the presence of relative movements between the sole holder and the bearing casing or bearing block of the toe binding fixture, can be determined with greater exactitude as well. Therefore, a very delicate and sensitive change in and adjustment of the release values has now been provided for the sole holder of such a toe binding fixture in a surprisingly simple manner. In addition, the useful life of such a bearing arrangement can be prolonged as well, because the components of the bearing are no longer directly stressed by the initial forces of tension exerted, for example by the release device, and acting in the various three-dimensional directions.

A further development of the embodiment of the invention, in which the release device is arranged outside of the interior space of the socket of the ball-and-socket joint receiving a spherical segment, is advantageous in that the friction ratios between the spherical segment and the socket of the joint are evenly distributed over the surface.

Another embodiment, where the sole holder and/or at least a part of the sole holder is adapted for pivoting relative to the bearing block around a transverse axis extending parallel to the support surface and perpendicularly to the longitudinal axis, is advantageous as well in that upward swiveling of the sole holders within area of the toe fixture is enhanced should the skier be falling backwards, so that the risk of suffering injury is reduced by using such a toe fixture.

According to a design variation, where an additional uncoupling device for positioning, damping and/or uncoupling the pivotal movement of the sole holder and/or at least of a part of the sole holder around the transverse axis, is arranged between the components of the ball-and-socket joints movable relative to one another, the release of the boot from the binding device is beneficially made possible also should the skier be toppling backwards, because in such falls backwards, only the front part or point of the boot lifts off from the ski, and any release in the area of the heel binding fixture is made impossible in this way. Serious injuries of the skier particularly such as torn ligaments and fractured joints are prevented in this manner.

According to another further developed embodiment of the invention, where the release device is forming at the same time the uncoupling device for the sole holder and/or at least a part of the sole holder, it is possible to achieve with such an uncoupling device the release of the sole holder in different three-dimensional directions.

An embodiment of the connecting device, in which a ball-and-socket joint is associated with each of the two sole holder components on both sides of the longitudinal axis of the connecting device, is advantageous as well in that it is possible in this way to achieve an even more precise guidance of the sole holder components and to obtain different release characteristics, for example when using the connecting device on a ski in the direction of the inner and in the direction of the outer edge of the ski. In addition, a longer useful life is achieved due to the reduction the stress acting on the ball-and-socket joints.

However, a further developed embodiment, in which the spherical segments associated with the two sole holders are arranged with their centers on a transverse axis, is advantageous as well in that the pivotal relations between the sole holder components can be kept equalized in each of the two directions extending transversely to the longitudinal axis of the ski.

Furthermore, an embodiment is feasible where the sole holders or sole holder components are connected via spherical arms with the spherical segments of the ball-and-socket joints. The guidance of the sole holder components, as well as a limitation of the mobility of the spherical segments versus the socket of the ball-and-socket joint can be realized in this way in a simpler manner.

Owing to the further developed embodiment, where a guide arrangement with a fixing means is arranged between the spherical arms of the ball-and-socket joints, and the sole holders or sole holder components, and the sole holder or the sole holder components can be pivoted and fixed via such a guide arrangement relative to the spherical segments in the longitudinal direction of the vertical axis, it is possible to adjust and adapt the sole holder components in a simple way to differently designed ski boots.

Furthermore, an embodiment variation, in which a guide arrangement with a fixing means is arranged between the spherical arms of the ball-and-socket joints and the sole holders or sole holder components, and the sole holder or the sole holder components can be pivoted around the vertical axis and fixed via said guide arrangement in relation to the spherical segments, is advantageous in that it permits simple and exact adjustment of the sole holders or sole holder components to different shapes of the tip of a ski boot.

According to the embodiment of the connecting device, in which the release device or its pre-tensioning spring is arranged outside of an axis extending through the center of the spherical segments towards the longitudinal axis in the direction of the protruding sole holder component, favorable error characteristics and damping characteristics of the release device are obtained because the interaction occurring between the compressive force generated by the spiral spring, and the torsional stress acting on said spring can be exploited in this way for controlling the supporting movement.

Furthermore, an embodiment, where the release device or its pre-tensioning spring is arranged extending at an angle relative to the longitudinal axis, makes it possible to achieve different damping values through the torsion of the pre-tensioning spring depending on the angular position.

However, possible is also an embodiment, in which the release device or its pre-tensioning spring are arranged extending concentrically with an axis extending parallel to the longitudinal axis and through the center of the ball-and-socket joint associated with the respective sole holder component, or where the release devices are arranged on support arms extending from the ball-and-socket joints in the direction opposing the support surfaces of the sole holders for the boot, is feasible as well, allowing in this way a compact structure of the connecting device.

The further developed embodiment, in which the release devices for the sole holder are aligned parallel to the transverse axis, and pre-tensioning springs, with their ends facing one another, are supported on a holding arm extending between said springs along the longitudinal axis extending in the center of the connecting device, said holding arm being connected with the socket of the ball-and-socket joint, permits easy specification or fixation of individual uncoupling conditions for the rotation of the toe binding fixture in opposite directions in conjunction with a one-component sole holder as well.

Further design variations, according to which a pre-tensioning spring of the release device is arranged at a higher vertical level from a support surface of the connecting device than an axis extending through the center of the spherical hub of the ball-and-socket joints parallel to the longitudinal axis, and/or where a pre-tensioning spring of the release devices is arranged concentrically on an axis extending parallel to the longitudinal axis through the center of the spherical hubs of the ball-and-socket joints, permit simple adjustment of connecting devices rated for different stress values. In conjunction with ski bindings rated for different stress factors, for example, the Z-number can be rated by selecting different values for the vertical spacing of the pre-tensioning spring from the support or mounting surface.

A design, in connection with which the release device or its pre-tensioning spring is supported on the sole holder or sole holder component via a sliding element, is advantageous in that the characteristics of the release device is not adversely changed by the pivotal movement of the sole holder, for example around a transverse axis.

The release device is sensitively responding or triggered also if the sliding element of the release device in a sliding or guiding track extending approximately parallel to the vertical axis, and/or the sliding element is realized in the form of a rolling body, e.g. a ball or roll.

Mounting and dismantling of the connecting device are facilitated by embodiments in which the socket of the ball-and-socket joint is assembled from a number of socket components, and/or where a dividing plane of the socket of said joint is arranged on a vertical plane extending parallel to the longitudinal axis and/or transverse axis, and/or where the components of the socket of the ball-and-socket joint are joined with one another via connecting means.

However, feasible is also a design according to which the sole holder is guided for pivoting about the ball-and-socket joint via a guide track in a plane extending parallel to the mounting or supporting surface. In this way, the acting forces are caught and absorbed for their major part via the ball-and-socket joint, and the latter, which permits guidance without play, is protected from any peaks in such forces.

However, a further developed embodiment can be realized as well, in which one of the components of the ball-and-socket joint is formed by a spherical hub, and the other component of said joint by a socket, with one of said components being stationarily connected with the bearing block fixed on the ski. In this way, a highly stressable guide arrangement is provided for the relative movement of the bearing components of the ball-and-socket joint in several three-dimensional directions.

In another further developed embodiment, according to which the spherical hub is formed by a spherical segment having a height larger than the radius of the ball, but smaller than the diameter of the spherical segment, is advantageous in that guidance on all sides in a number of three-dimensional directions is achieved solely by means of the ball-and-socket joint.

Advantageous is also an embodiment where the socket of the joint is formed by a spherical indentation segment having a height larger than the diameter of the ball, but smaller than the height of the spherical segment of the spherical hub, because in this way, the spherical hub can be guided and held in the socket of the ball-and-socket joint in several axes.

A further developed embodiment, where the radius of the ball of the spherical hub is smaller than the spherical radius of the spherical indentation segment, is advantageous in that it is possible to obtain any clearance required for reducing the friction between the moving components, on the one hand, and adequate clearance for admitting, e.g. lubricants on the other.

An embodiment of the connecting device, where the spherical hub is divided at least over part of the height of the spherical segment is divided in several sectors by at least one radially extending groove, is advantageous in that the ball-and-socket joint can be assembled in this way without using divided joint sockets.

Further developed embodiments, where at least one sole holder component can be adjusted and fixed versus a central component of the sole holder, said central component being provided with the spherical hub or the socket of the joint, in the direction extending perpendicularly to the mounting or supporting surface. In this way, the connecting device can be quickly adapted to different ski boots.

Another embodiment, in conjunction with which at least one sole holder component can be pivoted around an axis extending perpendicularly to the support surface, and/or adjusted and fixed there vis-à-vis the central component of the sole holder provided with the spherical hub or the socket of the joint, permits in an advantageous manner quick adaptation of the connecting device to different boot widths as well.

An embodiment, where the uncoupling device is associated with one sole holder component of each sole holder, is beneficial as well in that highly stressable guidance of the sole holder is achievable in this way.

Owing to the further developed embodiment, where the uncoupling device is supported on a side of the sole holder or sole holder component facing away from the support surface, and aligned parallel to a vertical axis, quicker detachment is achieved between the sole holder and the boot in the course of the uncoupling process.

Advantageous is also a design variation according to which the uncoupling device comprises a damping element and/or a spring whose damping or uncoupling characteristics is adjustable via an adjusting element, because sensitively responding uncoupling of the sole holder or sole holder components is achieved in this manner via a transverse axis.

A design variation of the connecting device, in which an uncoupling device and/or its spring are aligned approximately parallel to the longitudinal axis of the connecting device, and the sole holder is supported in the area of the longitudinal axis of the connecting device via a support arm on the sole holder or sole holder component, or a central component of the sole holders, is advantageous as well in that sensitive damping and uncoupling are achieved when the sole holder or sole holder component is pivoted.

A simple and highly stressable embodiment of the ball-and-socket joint is obtainable with a further developed design, according to which the guide track is formed by an additional ball-and-socket joint, and the spherical centers of the spherical hubs of the two ball-and-socket joints are arranged on a pivotal axis extending perpendicularly to the support surface.

Furthermore, favorable uncoupling characteristics is achieved with another further developed embodiment, in which the pivotal axis of the spherical hubs of the two ball-and-socket joints is inclined by 0.01° to 20°, preferably by 5° to 10° versus the stand-on surface in the direction opposing the boot support surface on the sole holder.

Furthermore, a design variation, in which the sockets of the two ball-and-socket joints are formed by the components of said ball-and-socket joints, and a separation plane of said joint socket components is connected in a fixed manner with the sole holder through the centers of the two spherical indentation segments or spherical segments of the spherical hubs by means of a hub stub, is advantageous in that this facilitates the mounting of multi-component ball-and-socket joints.

An embodiment, in which the sockets of the ball-and-socket joints are provided with a track for guiding the spherical arm, specifically a breakthrough, and part of the circumference of the breakthrough is forming the guide track for guiding the sole holder, is advantageous as well in that the edge in the breakthrough of the joint socket can be used as a means for guiding the hub stub and thus for the sole holder.

Furthermore, an embodiment, in which a component of the joint socket arranged on the plane penetrating the center of the spherical hub in the direction of the hub stub, is adjustable in the direction of said hub stub, is advantageous in that it permits damping of the vibrations in the direction extending perpendicularly to the set-up direction of the bearing block, or release of the uncoupling movement in the area of the ball-and-socket joint in case of overstressing.

Furthermore, an embodiment of the connecting device is feasible, in which the component of the joint socket is pressed against the remaining part of the joint socket via a pre-tensioning element with a preferably pre-settable tensile force. In this way, it is possible to define via the joint socket component an initial tensile force releasing the uncoupling process.

A design variation, according to which a damping element, particularly an automatically, elastically rebounding damping element made of rubber and/or plastic is arranged between the adjustable component of the joint socket and the spherical hub, is advantageous as well in that stress caused by impacts or shocks acting on the foot of the skier can be avoided in this way if the sports equipment is continued to be used.

BRIEF DESCRIPTION OF THE DRAWINGS

The invention is explained in the following in greater detail with the help of the exemplified embodiments shown in the drawings, in which.

DETAILED DESCRIPTION OF PREFERRED EMBODIMENTS

It is noted herewith by way of introduction that in the different embodiments described herein, identical components are denoted by the same reference number or same component designations, whereby the disclosures contained throughout the entire specification can be applied in the same sense to identical components with the same component designations. Furthermore, data relating to position such as, e.g. "top", "bottom", "lateral" etc. selected in the specification relate to the directly referred to figure described and shown herein, and have to be applied to any new position where a position has changed. Moreover, individual features or combinations of features in the individual exemplified embodiments shown and described herein may per se represent independent inventive solutions or solutions as defined by the invention.

Figure 1:
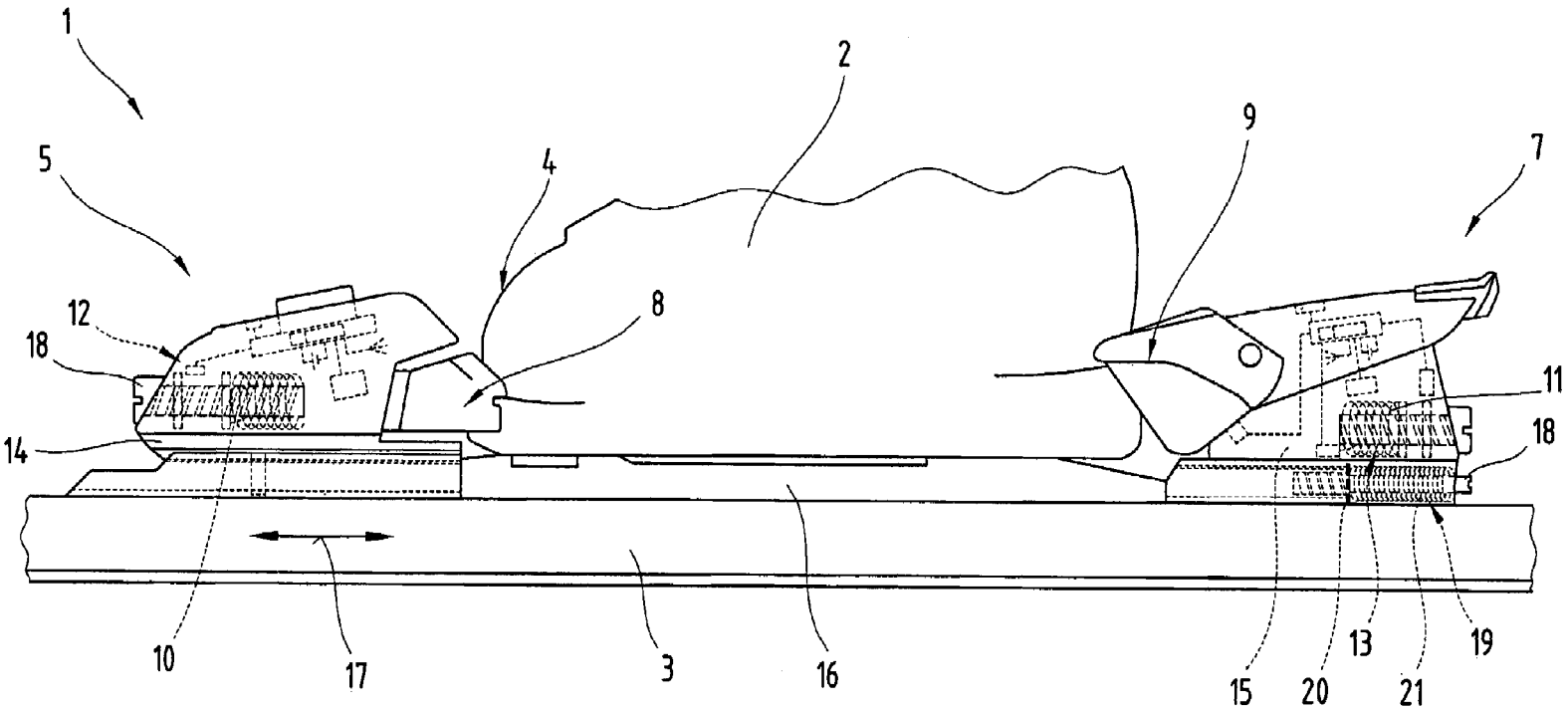
FIG. 1 is a side view and schematic representation of the connecting device as defined by the invention between a boot and a board-like type of sports equipment, particularly a ski binding.

FIG. 1 shows a connecting device 1, by which a boot 2, particularly a ski boot, can be secured on a board-like type of sports equipment 3 such as a ski, a snowboard, or a roller skating board.

A front or toe binding fixture 5 is associated with the tip 4 of the ski boot 2, and a rear or heel binding fixture 7 with the heel area 6 of the ski boot 2. Each of the toe and rear binding fixtures 5 and 7 is provided with the sole holders 8 and 9, respectively, which are engaged by the boot 2, said boot holders keeping the latter secured in its position on the sports equipment 3. In addition, the boot 2 is clamped between the sole holders 8 and 9 through application of a tensile force, which is exerted by the tension springs 10 and 11, respectively, which are associated with the toe and heel binding fixtures 5 and 7, respectively. Furthermore, the sole holders 8 and 9 each are fixed in a central position in relation to the bearing blocks 14 and 15, respectively, or relative to the bearing housings of the toe and heel binding fixtures 7 and 8, respectively, as well. If necessary, a schematically indicated, a support plate 16 supporting the binding may be arranged between the toe and heel binding fixtures 5 and 7, respectively, whereby the toe and heel binding fixtures may be arranged on said binding support plate 15 as well. The latter may be comprised of multiple components and provided with central adjustment devices for adapting the size of the boot 2 to the binding fixtures.

By using the release devices 12 and 13 in the toe and heel binding fixes 5 and 7, respectively, it is possible to provide a binding device 1 usually referred to as a safety ski binding, which, as schematically indicated, preferably may comprise also adjustment mechanisms for individually adjusting the positions of the toe and heel binding fixtures 5 and 7 relative to each other, and/or for adjusting the unit comprised of the toe and heel binding fixtures 5 and 7 vis-à-vis the longitudinal expanse of the board-like type of sports equipment 3.

With the help of such adjustment mechanisms, which are known in the prior art in many varieties, it is possible to easily adapt the connecting devices 1 without problems to the given size of the boot or its sole, and/or to individually displace in the longitudinal direction of the sports device 3 the point where force is introduced between the connecting device 1 and the sports device 3 or the binding support plate.

Such a connecting device 1, i.e. the toe and heel binding fixtures 5 and 7 have—as it is known per se—a predefined adjustment range for the safety uncoupling value or maximal retention value of the boot 2 so as to be able to cover in conjunction with the given type of binding a multitude of different conditions or users. Said a safety uncoupling value, or the so-called Z-value, can be adapted to the individual requirements of the user, or to the applicable safety requirements by means of an adjusting screw 18 of the release devices 12 and 13 in the toe and heel binding fixtures 5 and 7, respectively. Likewise, said safety uncoupling value or Z-value can be changed or adjusted via the adjusting screw 18 of the release devices 12 and 13 on an independent release device in the heel binding fixture 7. As it is known per se, said release devices 12 and 13 or variable adjustment mechanisms in the toe and heel binding fixtures 5 and 7, respectively, serve the purpose of permitting the boot 2 to be released from the sports device 3 at any time should excessive stress conditions occur, under which the user is exposed to any increased risk of suffering injury. Since the release devices 12 and 13 are independent of one another, it is basically possible to adjust safety uncoupling values that deviate from each other.

In order to permit minor relative movements between the toe and heel binding fixtures 5 and 7, respectively or between at least one of said fixtures and the sports equipment 3, provision is made for a so-called extending or length equalization or compensation spring suspension, which, like in the present exemplified embodiment, is usually accommodated in the heel binding fixture 7.

As known per se, the effect of such an extending spring suspension 19 is that the boot 2 inserted in the connecting device 1 between the toe and heel binding fixtures 5 and 7, respectively, is retained there with as little play or clearance as possible. Such an extending spring suspension may also serve the purpose of compensating or absorbing at least in part any angular change occurring as the sports equipment 3 is being used, including changes in the spacing between the toe and heel binding fixtures 5 and 7, respectively, and the sports device 3. Such an extending spring suspension 19 is comprised of, for example an abutment 20 fixed on the ski, or an abutment fixed on a one-component or multi-component, ribbon-like connection element between the toe and heel binding fixtures 5 and 7, respectively. An elastically yielding element, for example a spring such as the coil spring 21, is associated with said stationary abutment, said spring 21 permitting limited relative adjustments between the bearing block 15 of the heel binding fixture 7 and the sports device 3, or versus a longitudinal guide 22 fixed on the ski for guiding the heel binding fixture 7. The initial tension of the elastic abutment, particularly the coil spring and thus the characteristics of the extending spring suspension 19 is adjustable by means of an adjustment screw 23, and/or the relative position of the heel binding fixture 7 is adjustable by means of such an adjustment screw vis-à-vis the longitudinal guide 22, or changeable versus the ski boot 2 as required, so that an adaptation to different boot sizes or adjustments of the contact pressure can be carried out. With the boot 2 inserted in the connecting device 1, the elastic element, particularly the coil spring 21 of the extending spring suspension 19 is stressed in any case, preferably slightly compressed, and the heel binding fixture is driven to a minor extent in the longitudinal guide 22 in the direction from the toe binding fixture 5 towards the end of the sport device oppositely disposed in the toe binding fixture, so that due to the compressive force exerted by the extending spring suspension 19, the ski boot 2 is inserted without play in the longitudinal direction of the sports equipment 3 between the toe and heel binding fixtures 5 and 7, respectively.

Within the framework of the invention, it is naturally possible also to accommodate some compensating mechanics conforming to such an extending type of spring suspension 19 in the toe and heel binding fixtures 5 and 7, respectively. The measure of such an adjustment, or the contact pressure exerted by the extending spring 19 versus the inserted boot 2 is important for the appropriate functioning and safety of the performance or efficiency achievable with the connecting system 1, on the one hand. In particular, if the contact pressure is too low, an undesirable relative movement may ensue between the connecting system 1 and the boot 2, or the bending characteristics of the sports device 3 may be adversely influenced if the contact pressure is too high, or the safety uncoupling values adjusted on the toe and heel binding fixtures 5 and 7, respectively, may be excessively impaired or falsified, on the other hand.

FIGS. 2 to 8 show the toe binding fixture 5 of the connecting device 1 in detail. As shown by the schematic representation in FIG. 2, said toe binding fixture 5 comprises the sole holder components 24 and 25 arranged on the one and other side of the longitudinal center axis 17 of the sports device 3, said sole holder components 24 and 25 each being arranged via their own ball-and-socket joints 26 and 27, respectively, in the bearing block 14 or the housing of the toe binding fixture 5. In the present exemplified embodiment, the components of the ball-and-socket joint 26 are formed by a spherical hub 28 and a joint socket 29.

The two joint sockets 29 are assembled from the two joint socket components 30 and 31, whereby a dividing plane 32 is preferably extending through the centers 33 of the spherical hubs 28. It is, of course, possible also to arrange the dividing plane in any other desired area across the diameter 34 of the spherical hubs 28.

The two joint socket components 30 and 31 can be guided one in the other via means and guide extensions known in the field of mechanical engineering such as, for example positive guiding elements such as fitted pins, dovetail guides or the like, and can be connected with one another in their positions relative to each other via the connecting means 35, e.g. screws as used in the exemplified embodiment presently shown, but also by means of gluing and other joining methods. This permits insertion of the spherical hubs 28 in the joint sockets 29 and to subsequently mount thereon the further joint socket component 31, so that the spherical segments 36 or also the full balls are movably mounted and held in the spherical indentation segments 37 on all sides. The spherical hubs 28 and the joint sockets 29 are preferably formed in such as way that they have a common center 33.

Figure 3:
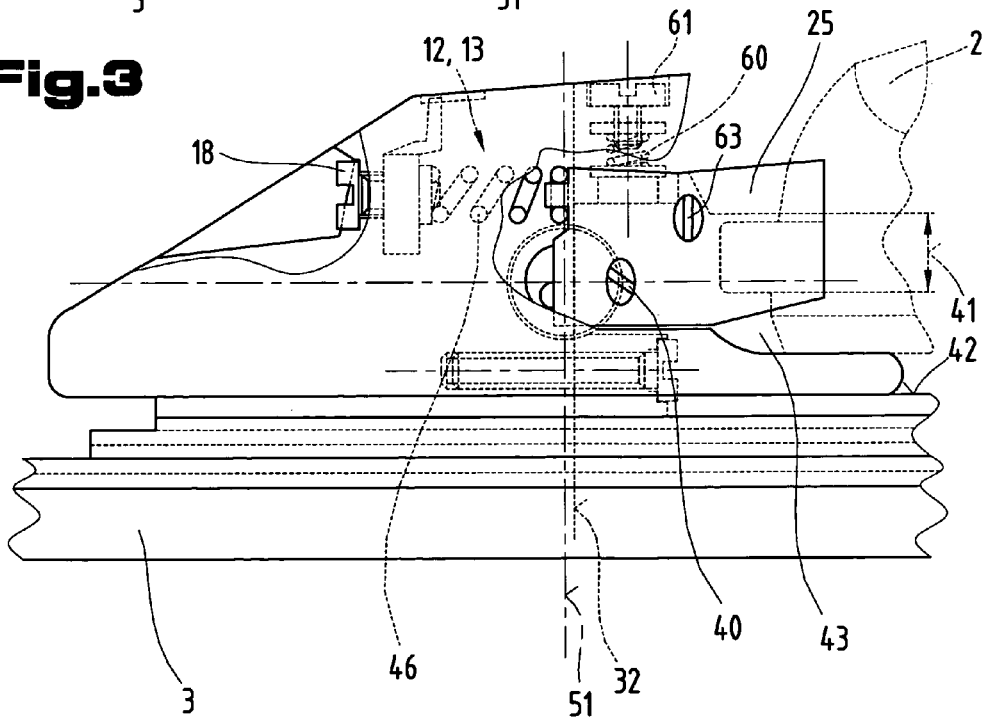
FIG. 3 is a partly sectional, side view of the front or toe binding fixture according to FIG. 2.
Figure 4:
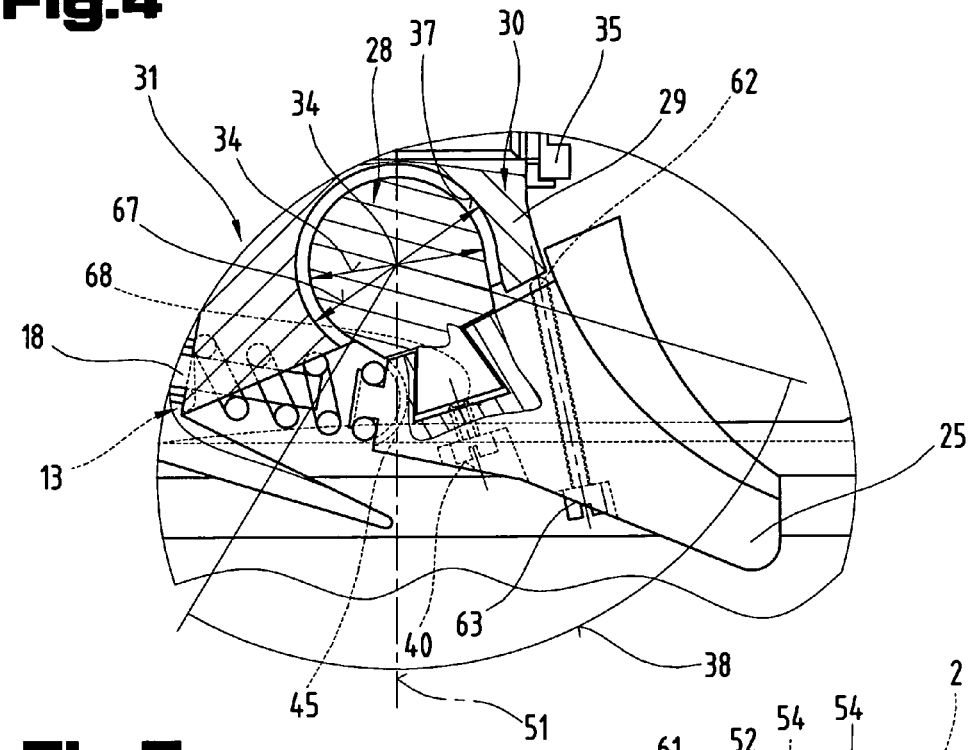
FIG. 4 is a top view and sectional and enlarged schematic representation of a detail of the toe binding fixture according to FIG. 2.

As more clearly shown in FIG. 4, the opening angle 38 of the joint sockets or spherical indentation segment 37 is smaller than 180° and preferably in the range of between 170° and 45°, however, usually in the range of between 150° and 90°. The spherical hub projects from the joint socket 29 or spherical indentation segment 37 across the range of the opening angle 38. The spherical segment 36 is rotatable versus the stationary spherical indentation segment 37, and one spherical segment 36 is connected with each of the two sole holder components 25 and 26. It is possible, for example, to mold the spherical segment 36 onto the sole holder component 24, forming one piece with the latter. However, as shown more clearly in FIGS. 2 and 3, it is possible also to manufacture two separate parts, which are then joined to form one single component by welding or gluing said separate parts together. Preferably, however, as shown by the socket holder component 25, the sole holder components 24 and 25 are formed as two-component parts, and the spherical segment 36 is provided with a guide arrangement 39, e.g. a component of a dovetail guide, whereas the hole holder component 25 comprises the counterpart of the guide arrangement, e.g. the dovetail guide. Via a fixing means 40, e.g. a screw or a locking or clamping lever arrangement, the sole holder component 25 can be set and adjusted to its vertical spacing 41 relative to the top side 42 of the sports device 3, so that the sole holder components 24 and 25 can be exactly set and adjusted to the height of the sole protrusion 43 of the boot 2 in FIG. 3.

The opening angle 44 of the sole holder components 24 and 25 is preferably adjustable as well in relation to the longitudinal axis 17 in the longitudinal direction of the connecting device 1, whereby a counter-holding part 45 could conceivably be formed for said purpose by a part of the sole holder 25. In this connection, such a counter-holding part 45 could be arranged in the longitudinal direction or direction of actuation of the tension spring 46 and adjusted with the help of an adjustment device not shown, e.g. a set screw, whereby said counter-holding part 45 is relatively adjusted in the longitudinal direction of the tension spring 46 up to the sole holder 25, permitting the latter to be positioned lengthwise. Such an arrangement can be provided of course in the same sense for the sole holder component 24 as well.

Figure 2:
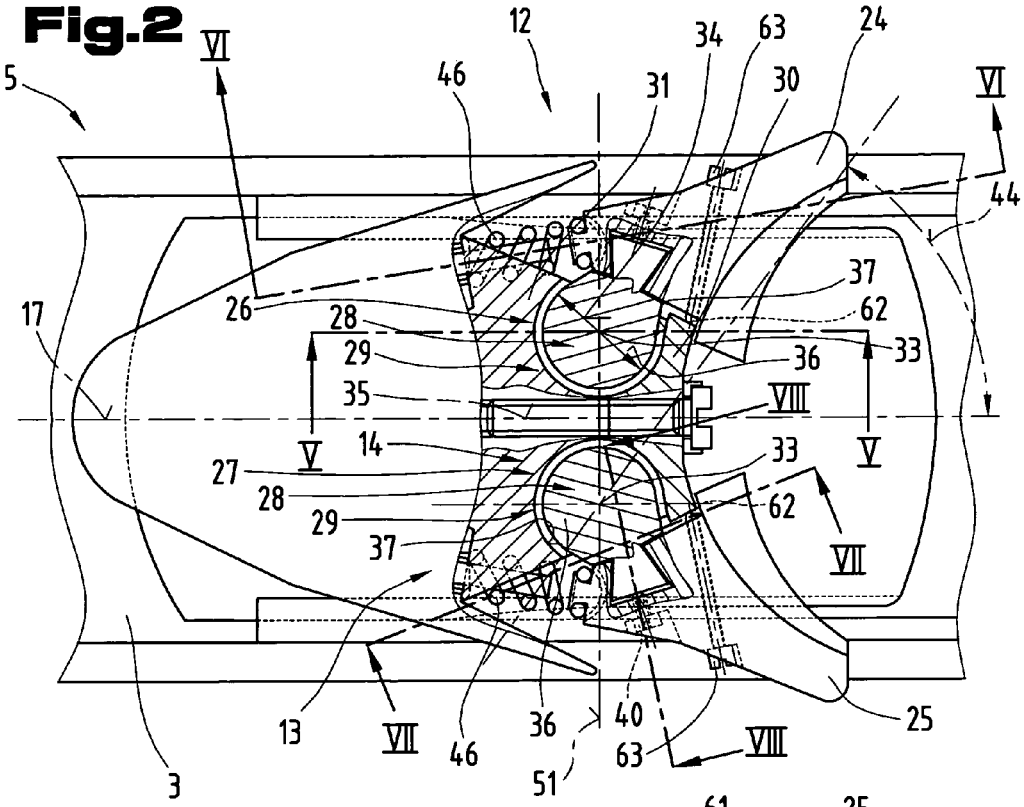
FIG. 2 is a top view and partly sectional, simplified schematic representation of a front or toe binding fixture of the connecting device as defined by the invention.
Figure 5:
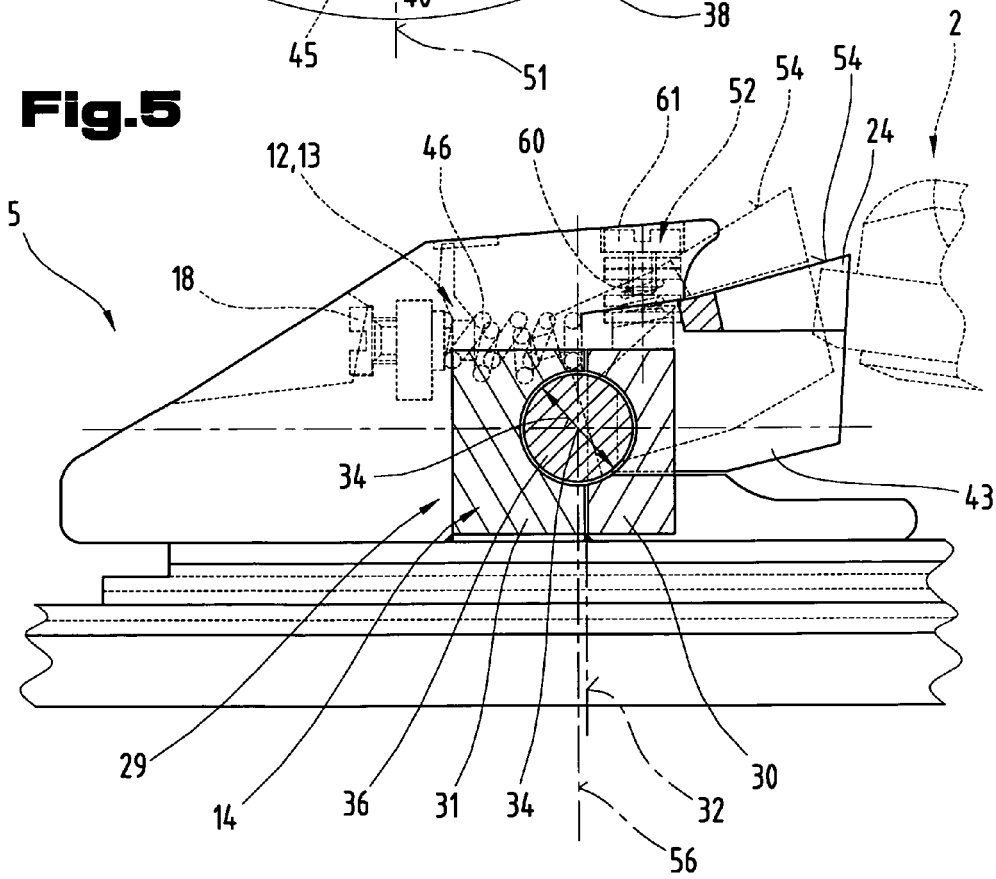
FIG. 5 is a sectional side view of the toe binding fixture according to FIGS. 2 to 4 cut along lines V-V in FIG. 2.
Figure 6:
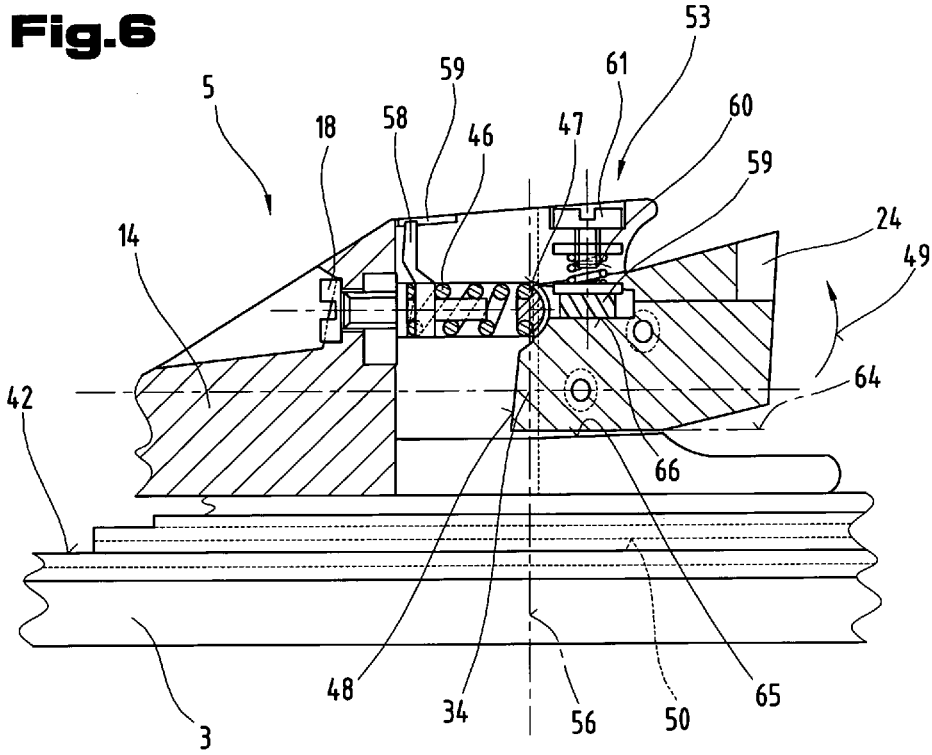
FIG. 6 is a sectional side view of a part of the toe binding fixture cut according to lines VI-VI in FIG. 2.

Furthermore, it is shown in FIGS. 2, 3 and 6 within the area of the swiveling sole holder component 25 that the uncoupling characteristics of the sole holder component 24, which is determined by the tension spring 46, can be changed accordingly by the adjustment screw 18. With higher pre-compression set accordingly for the tension spring 46, the sole holder component 24 or 25 will pivot outwards only in the presence of higher forces acting between the boot 2 and the sports device 3, and will release the boot 2 only in the presence of higher lateral forces. In the reversed sense, the boot 2 will be released from the sports device 3 earlier or in the presence of lesser stress or differential forces if the initial tension of the tension spring 46 has been reduced by means of the adjustment screw 18. In this conjunction, the adjustment screw 18 may penetrate part of the stationary bearing block 14 in a thread, so that the initial tension of the tension spring 46 can be changed depending on the depth to which said adjustment screw 18 has been screwed into the thread. For said purpose, the tension springs 46 are preferably aligned with the center 34 of the spherical hubs 28, and provision is made for a front sliding element 47, which can be inserted in the face-side end of the tension spring 46, covering the latter, and which may be rounded on all sides, or can be realized in the form of a spherical indentation segment. A guide track 48 is associated with said sliding element 47, in which the latter is slidingly displaced when the sole holders 24 and 25 are pivoting, while in the course of such pivotal movements of the sole holders as well as in the center 34 in the direction indicated by arrow 49, it is possible to maintain the uncoupling values of the tension spring 46 and the influx of safety factors in the toe binding fixture 5. It is important in this conjunction that the characteristics of damping or uncoupling movement of the sole holders 24 and 25 according to arrow 49 (FIG. 6) is not changed in terms of so-called "uncoupling rearwards" of the connecting device, but that with the sole holders 24 and 25 pivoting about the transverse axis 51 (FIG. 4) extending parallel to the support surface 50 of the connecting device 1 on the top side 42 of the sports device 3, such pivotal motion being indicated by arrow 49 (in FIG. 6), the sole holders 24 and 25 are exclusively controlled via the uncoupling devices 52 and 53, respectively (FIGS. 5 and 6).

Now, if one or both of the sole holders 8 and 9 are pivoted due to the effect of the ball-and-socket joints 26 and 27, respectively, about the transverse axis 51 extending parallel to the support surface 50 of the bearing block 14, said support surface being associated with the top side 42 of the sports device 3, as it is shown more clearly in FIG. 4, i.e. pivoting from the holding position 54 shown by fully drawn lines in FIG. 5, where the sole holder components 24 and 25 retain the boot 2 in the connecting device 1, into the uncoupling position 55, where said sole holder components have been pivoted outwards as indicated by broken lines in the direction of arrow 49, the limitation of such pivotal movement of said sole holders 8 and 9, or their damping or pivotal motion outwards for uncoupling the boot 2, is controlled as exclusively as possible by the uncoupling devices 52 and 53, respectively.

Therefore, while the characteristics or the retaining forces and the uncoupling movement for releasing the sole holders 24 and 25 counteracting any fall of the skier rearwards, are set and effected by the uncoupling devices 52 and 53, respectively, the characteristics of the release values in the event of so-called "rotational falling" of the skier, in connection with which the sole holders 24 and 25 pivot about the vertical axes 56 (FIGS. 3 and 5 to 8) extending perpendicularly to the support surface 50, is adjusted for the sole holders 24 and 25 by the release devices 12 and 13, respectively, said release devices being arranged independently of the ball-and-socket joints 26 and 27, respectively.

If each of the two sole holder components 24 and 25, e.g. of the sole holder 8 of the toe binding fixture 5, has its own release device 12 and 13, respectively, with each of the latter having its own tension spring 46, the uncoupling force acting if the skier is falling sideways, can be adjusted separately, i.e. for pivoting the sole holder components 24 and 25 about the vertical axes 56.

As explained already above, the characteristics of the release devices 12 and 13 can be adjusted by means of the adjustment screws 18. Of course, any other desired spring arrangements such as, e.g. tensile springs or also plate springs, flexible bars and the like can be employed instead of the screw pressure springs shown. Furthermore, so-called gas springs, i.e. damping and uncoupling elements functioning with the use of incompressible or compressible media, can be employed for said purpose as well.

Furthermore, the pre-tensioning forces can be adjusted in any desired way as well with known systems such as screw arrangements, adjustment nuts, adjustable locking elements etc.

In order to indicate to the user of such a connecting device 1 the adjusted values within the area of the release devices 12 and 13, it is possible to connect an indicator 58, e.g. a trailing indicator connected with the adjustable components of the release device 12, 13, whereby the position of such an indicator is readable through a window or recess 59 within the area of the toe binding fixture. Such an indicator (not shown) can be naturally associated in the same way with the uncoupling devices 52 and 53 as well. Furthermore, provision can be made for arranging suitable electronic or electromechanical sensors displaying the given adjustment of the release devices 12 and 13 and the uncoupling devices 52 and 53, respectively, on a display, or in any other desired manner, for example via a "Bluetooth" interface or a mobile telephone.

As shown in FIGS. 5 and 6, the uncoupling devices 52, 53 are arranged between components of the ball-and-socket joints 26 and 27, respectively, that are movable relative to one another, thus between the spherical hub 28 and the socket of the joint. As more clearly shown in FIG. 6, such an uncoupling device 52, 53 may be formed by a damping element 54 made of an automatically, elastically rebounding, deformable material such as plastic and/or rubber, whose characteristics is designed in such a way that when a predefined force is exceeded, the sole holder components 24, 25 are capable of pivoting about the transverse axis 51 upwards in the direction of arrow 49 into the position shown in FIG. 5 by the broken lines, so that the sole protrusion 43 of the boot 2 under the sole holder components 24, 25 is enabled to freely pivot away upwards.

Such an uncoupling device 52, 53 makes it possible that should the skier fall backwards, toppling for example in the direction of the rear end of the sports device 3 or ski, the boot 2 can be released within the area of the toe binding fixture 5 upwards, thus away from the ski, and serious tendon injuries or joint fractures can be avoided in this way.

It is naturally possible also to employ the uncoupling device for damping by using it jointly with the damping element 59 without any uncoupling or release of the boot 2 taking place. In addition to the damping element 59, or instead of the latter, it is of course possible also to form the uncoupling device 52, 53 by any other desired means such as, e.g. the springs 60 with adjustable initial tension (FIGS. 5, 6), whereby the initial tension of such springs 60 can be pre-controlled with the adjustment elements 61. It is noted in this conjunction that the uncoupling device and the springs 60 are represented herein purely schematically, and that it is, of course, possible to use any other designs and means employed for said purposes in the prior art. It is possible also to associate with the adjustment elements 61 suitable sight windows with the indicator elements 57, so that the adjusted releasing or uncoupling forces are visible from the outside. The idle position of the sole holder components 24 and 25 can be additionally fixed by means of the stops 62 schematically shown in FIGS. 2 and 4, either depending on the action of the pre-tensioning spring 46 of the release devices 12, 13, or also independently thereof. Said stops 62 may be adjustable versus the bearing block 14 and/or the housing and/or the toe binding fixture, or the sole holders 8, 9, or the sole holder components 24, 25. An adjustment screw 63, for example, may serve said purpose, with the end of said screw facing the bearing block 14 forming the stops 62 in the present exemplified embodiments according to FIGS. 2 to 4.

Said stops 62 can be used also as final stops for positioning the sole holder components 24 and 25 in their respective idle positions particularly when no boot 2 is inserted in the connecting device 1.

Figure 7:
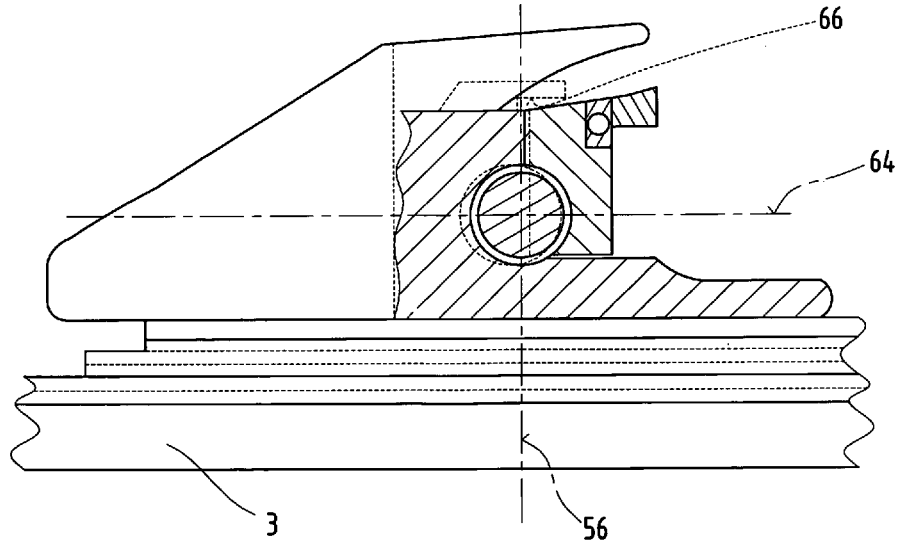
FIG. 7 is a sectional side view of a detail of the toe binding fixture according to FIGS. 2 to 6 cut according to lines VII-VII in FIG. 2.
Figure 8:
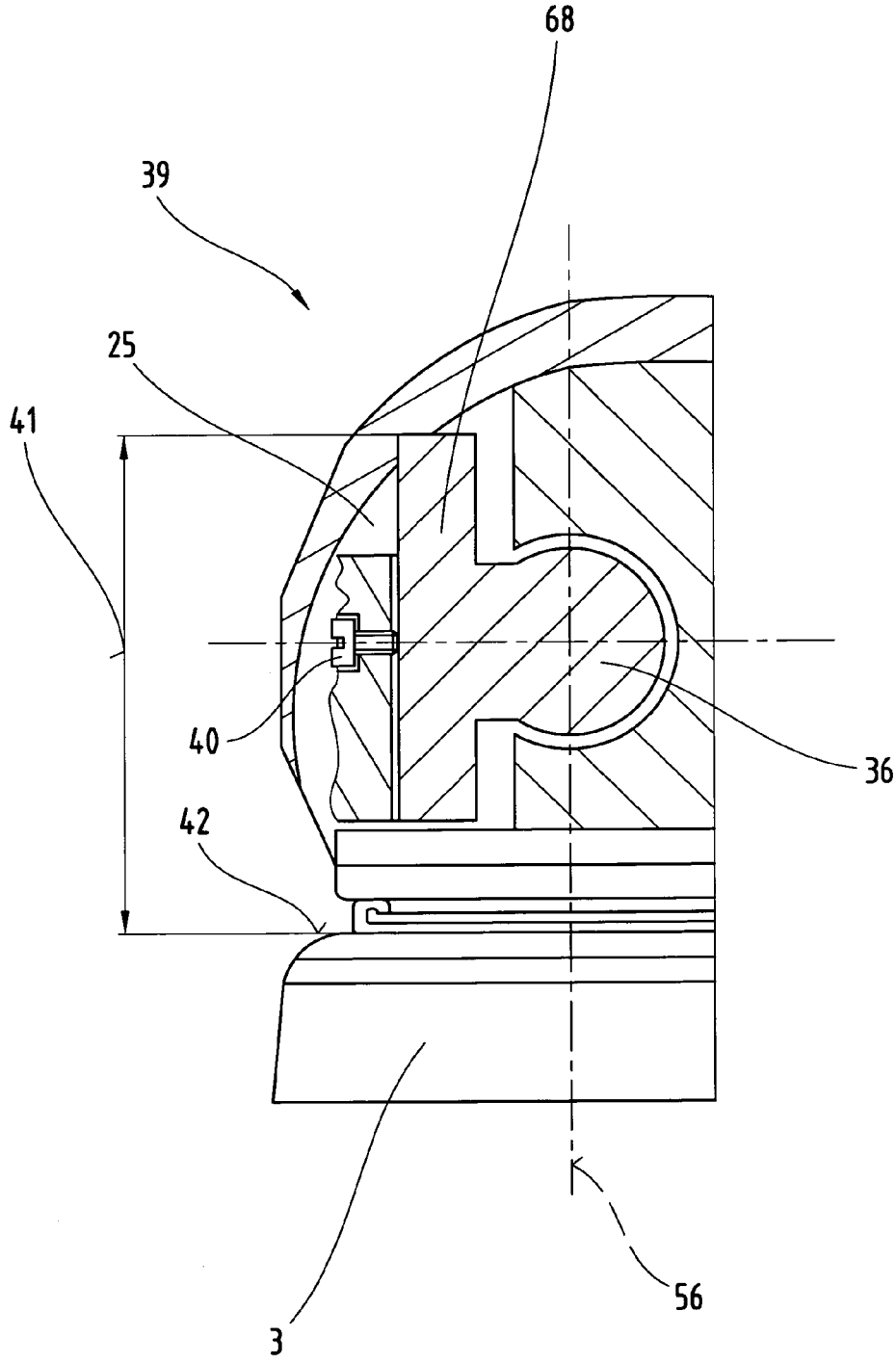
FIG. 8 is a sectional view of a part of the toe binding fixture according to FIGS. 2 to 7 cut according to lines VIII-VIII in FIG. 2.

For guiding the sole holder components 24 and 25 horizontally in a plane 64 (FIGS. 6, 7) extending parallel to the top side 42 of the sports equipment 3, the pre-tensioning springs 46 can be used, the latter being arranged next to the ball-and-socket joints 26 and 27. This is possibly primarily if the sole holder components 24 and 25 are to be capable of pivoting exclusively in the plane 64, i.e., if, for example, only so-called lateral uncoupling is to take place, thus in the direction of the lateral edges of the ski or sports equipment 3. In case the arrangement of the pre-tensioning spring 46 of the release device 12 or 13 should not be adequate for said purpose, it is possible also to associate with the sole holders 8 and 9 the guide tracks 65 and 66, respectively, thus a lower and an upper guide track as shown most clearly in FIGS. 6 and 7. In the simplest case, the guide tracks 65 and 66 can be formed by sliding surfaces, between which the sole holder components 24 and 25, respectively, are guided with vertical orientation. Only he upper sliding surface is schematically shown in FIG. 7 by broken lines in order to demonstrate how the sole holder components 24 and 25 of the sole holders 8 and 9, respectively, may be guided vertically if no additional uncoupling devices 52, 53 are present.

If the uncoupling devices 52 and 53 are available, however, the latter assume the function of the upper guide track via suitable means, for example by using sliding coatings on the damping element 59 or on the springs 60.

Naturally any other types of guiding elements can be employed as well, if need be, including guiding elements with integrated damping elements such as guiding strips, guiding rollers, or tracks for sliding blocks for guiding the sole holder components 24 and 25 vertically.

If, as shown in FIGS. 2 to 8, the connecting device 1 is embodied in a manner such that it will be possible to make provision for the further uncoupling devices 52 and 53 for releasing the pivotal movement of the sole holders 8 and 9 or sole holder components 24 and 25, respectively, around the transverse axis 51, provision is usually made for only a lower guide track 65 that prevents the sole holders 8, 9, or sole holder components 24, 25 from pivoting in the direction of the top side 42 of the sports equipment 3, whereas the sole holders 8 and 9 or the sole holder components 24 and 25, respectively, are supported via the uncoupling devices 52 and 53, respectively, for pivotal movements directed away from the top side 42. Now, while the embodiment according to FIGS. 2 to 8 permits individual adaptation of the uncoupling processes depending on which side of the boot or side of the sports equipment 3 is involved, such an embodiment requires greater expenditure with respect to the adjustment device and adjustment processes in order to permit uniform uncoupling of the two sole holder components 24, 25 around the vertical axis 56, but mainly around the horizontal transverse axis 51. In the present exemplified embodiment, the joint socket 29 of the ball-and-socket joints 26, 27, or the spherical indentation segment 37 formed in the joint socket, is arranged in the stationary bearing block 14 or housing of the toe binding fixture 5. It is shown most clearly in FIG. 5 that for mounting it, the joint socket 29 is divided in two joint socket components, with the plane of separation 32 being arranged in the present exemplified embodiment barely versus the plane of the spherical segments 36 receiving the centers 33. It is possible in this way to insert the spherical segments 36 with the sole holders 24, 25 molded thereon in the housing components or bearing block 14 mounted stationary in the toe binding fixture 5, whereupon said sole holders can be fixed relative to one another by means of the connecting means 35 (shown in FIGS. 2 and 3) by sliding the joint socket component 30 over the sole holders.

Such an embodiment permits selecting the diameter 34 of the spherical segment 36 exactly as or slightly smaller than the diameter 67 of the spherical indentation segment 37 in the joint socket component 31, so as to provide it, for example with a dimension of from 0.01 to 0.5 mm, preferably 0.01 to 0.3 mm. This permits the spherical segment 36 with the spherical indentation segment 37 to be exactly guided without clearance in all three-dimensional directions. However, a minor difference in dimension may be advantageous mainly in connection with metal components in order to be able to inject suitable lubricants between the two components, i.e. between the spherical segment 36 and the spherical indentation segment 37.

On the other hand, however, if said two components, i.e. the spherical segment 36 and the spherical indentation segment 37 are made of plastics, preferably self-lubricating plastics or self-lubricating metals, said components can be formed almost without any clearance.

It is naturally possible also to design the part of the spherical indentation segment projecting beyond the semispherical shape, i.e. the part having a height greater than the radius of the spherical indentation segment, in the form of a so-called snap bead. Such a snap bead, which forms the cross-section through which the spherical arm 68 (FIG. 4) adjoining the spherical segment is passing, may be provided for such passage with one or more slots extending radially in the peripheral direction, or such a snap bead can be formed using a material with a high coefficient of automatic, elastic rebounding.

If such a snap bead is employed, its effect is that the spherical hub 28 inserted in the joint socket 29 can be detached only with application of a force directed parallel to the spherical arm 68.

Now, it is advantageous in conjunction with the present exemplified embodiment that the joint arrangement is realized in the form of the ball-and-socket joints 26 and 27, and that the release devices 12 and 13 are arranged between their bearing blocks 14 and 15, respectively, and the sole holders 8 and 9, respectively, or the sole holder components 24 and 25, respectively, outside of the interior space of the joint socket 29 of the ball-and-socket joints 26 and 27 accommodating the spherical segment 36. In this way, the major part of the surface of the joint socket 29 and the spherical segment 36 can be used for guiding the two components relative to one another. Moreover, if the height of the spherical indentation segment 37 is dimensioned in such a way that it is larger than the radius of the spherical indentation segment, the spherical segment 36 can be guided in all three 3-dimensional directions without being influenced in any way.

In this connection, the design of the ball-and-socket joints 26 and 27 can be exclusively focused on exact guidance of the components moving in relation to one another, and no adaptation to uncoupling cams, if any, or the like is required.

Figure 9:
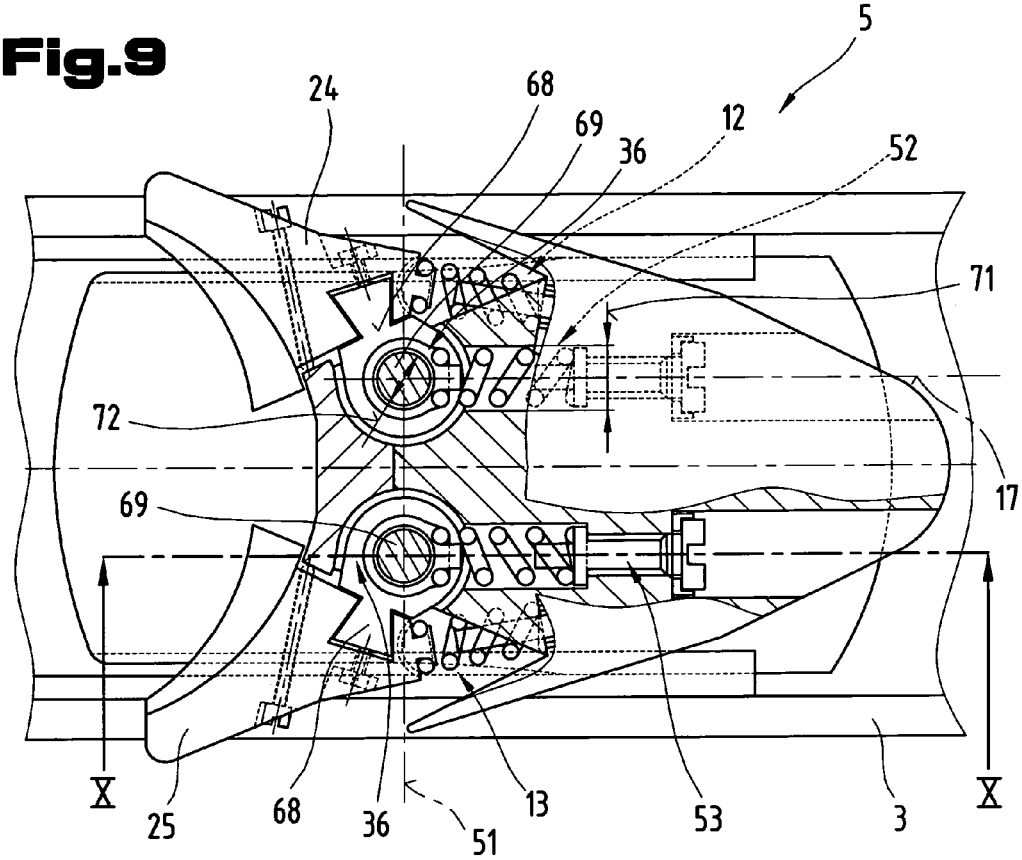
FIG. 9 is a partly sectional top view and simplified schematic representation of another design variation of a connecting device as defined by the invention.
Figure 10:
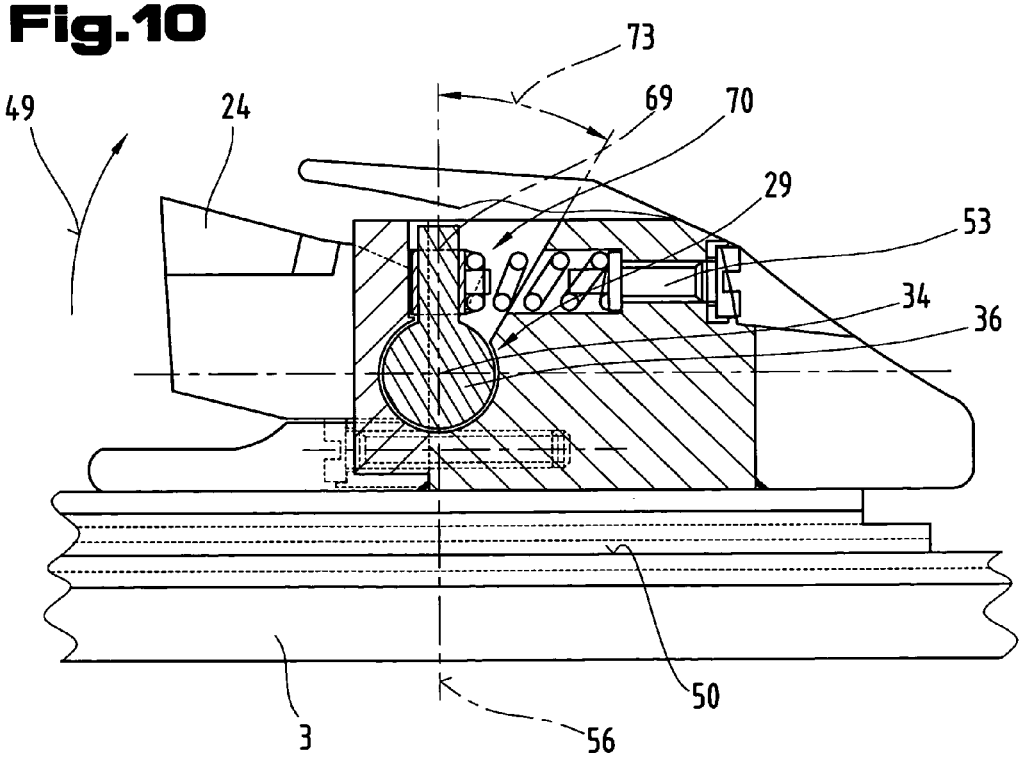
FIG. 10 is a sectional side view of the toe binding fixture according to FIG. 9 cut along lines X-X in FIG. 9

FIGS. 9 and 10 show another variation of the embodiment of the connecting device 1, specifically a toe binding fixture 5 in which identical components are denoted by the same reference numbers as those used in FIGS. 1 to 8. The embodiment according to FIGS. 9 and 10 is different from those shown in FIGS. 1 to 8 in that in addition to the spherical arm 68, on which the sole holder components 24 and 25 are arranged adjustably versus the spherical segments 36 in the manner described in FIGS. 2 to 8, provision is made for an additional or further spherical arm 69, which is extending in the direction of the vertical axis 56 through the center 34 of the spherical segment 36, projecting in the direction facing away from the support surface 50. For said purpose, provision is made in the joint socket 29 for an additional breakthrough 70, which, viewed from the top, has the shape of a slot with the width 71 that is equal to or larger than the diameter 72 of the spherical arm 69. In the longitudinal direction or parallel to the longitudinal axis 17, the length of said breakthrough 70 increases from the area of the joint socket 29 up into the area of the uncoupling devices 52,53, by means of which the uncoupling characteristics or mobility of the sole holder components 24, 25 can be adjusted and changed around the transverse axis 51 in the uncoupling direction. The opening angle 73 providing for mobility of the spherical arm 69 in the direction of the longitudinal axis 17 is coordinated in this connection in such a way that the sole holder components 24 and 25 are capable of pivoting to a certain extent around the transverse axis 51 in the direction leading away from the sports equipment 3, so that the sole holder of the boot 2 can be released for moving upwards and away from the sports equipment 3. The advantage of such a solution lies in that the uncoupling conditions for the release devices 12 and 13 for an uncoupling movement around the vertical axis 56 remain always the same, and that such rotation around the vertical axis 56 is not impairing in any way the uncoupling devices 52, 53 either, but that the latter are exclusively activated when the sole holder components 24, 25 are pivoted around the transverse axis 51 in the sense of arrow 49 by any uncoupling action directed backwards.

The other structure and features as a whole, in particular the adjustability of the sole holder components 24 vis-à-vis the spherical segments 36, and the stops 62 with the associated adjustment elements 63, as well as the embodiment of the release devices 12 and 13 correspond with those according to FIGS. 2 to 8. Said components are therefore denoted by identical reference numbers, and reference is made herewith to the relevant description of FIGS. 2 to 8.

FIGS. 11 to 14 show a design variation of the connecting device 1 as defined by the invention, in which the sole holder 8 of the toe binding fixture 5 is adapted for pivoting about one single ball-and-socket joint 26 in two three-dimensional directions extending at an angle in relation to each other, such as, for example around the vertical axis 56 and the horizontal, transverse axis 51.

Figure 11:
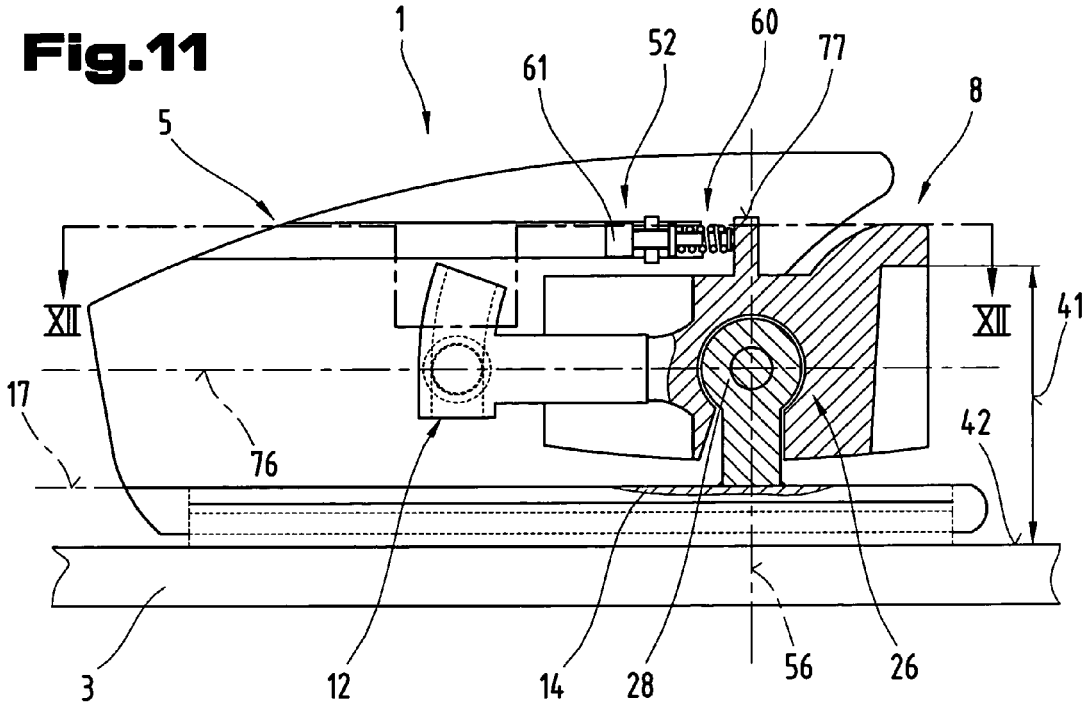
FIG. 11 is a sectional side view and simplified schematic representation of another design variation of the toe binding fixture as defined by the invention, with a section along lines XI-XI in FIG. 12.
Figure 12:
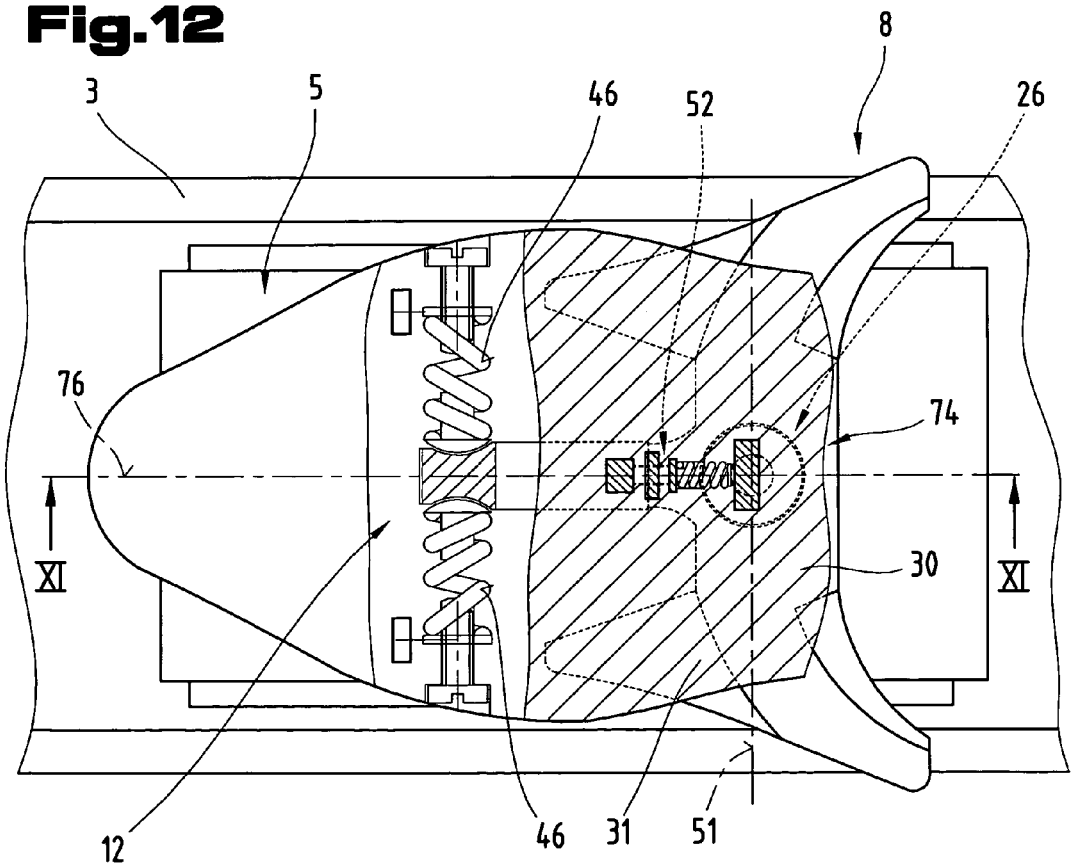
FIG. 12 is a partly sectional top view of the toe binding fixture according to FIG. 11, with a section along lines XII-XII in FIG. 11.
Figure 13:
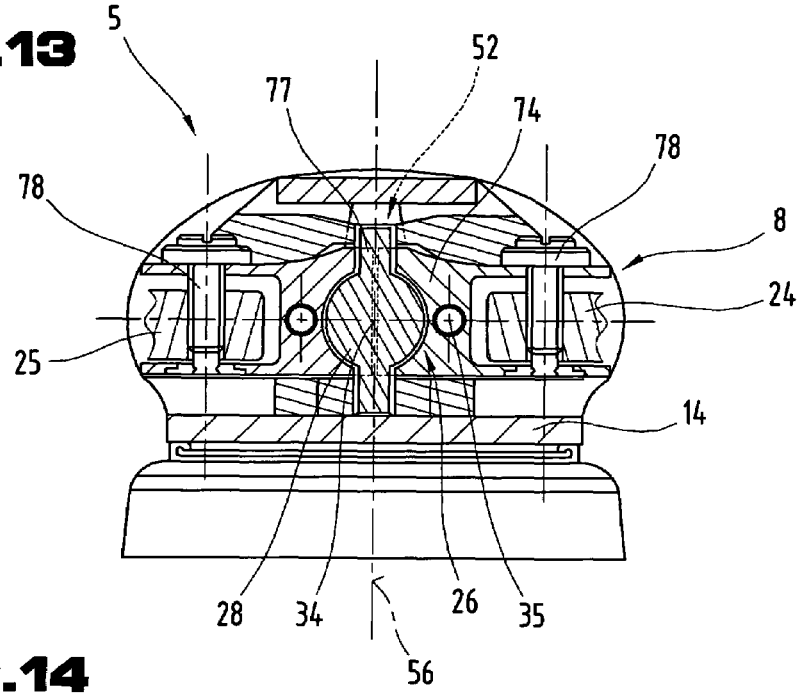
FIG. 13 is a sectional side view of another embodiment of the toe binding fixture as defined by the invention, with a section according to lines XIII-XIII in FIG. 14.
Figure 14:
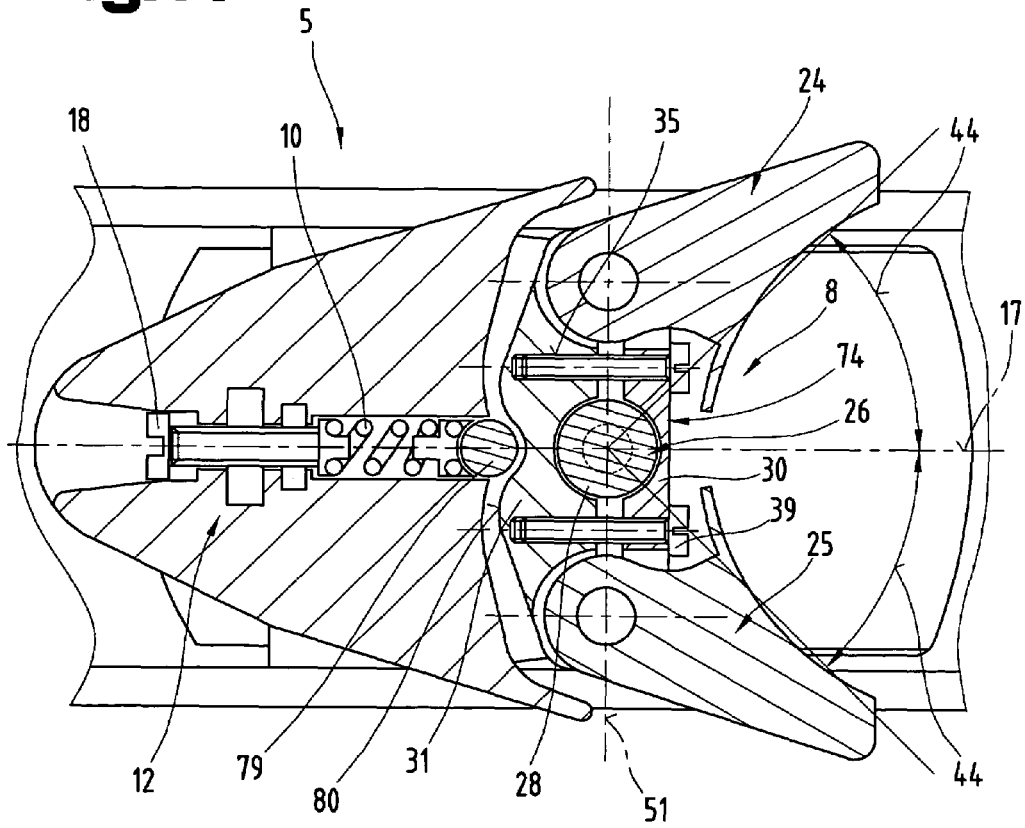
FIG. 14 is a top view of the toe binding fixture according to FIG. 13.

While FIGS. 11 and 12 show an embodiment, where the separate pre-tensioning springs 46 are shown for each of the uncoupling devices or each of the two directions of the sole holder 8, FIGS. 13 and 14 show an exemplified embodiment, in which one single central uncoupling spring is provided for the sole holder 8, with the two sole holder components 24 and 25 being adjustable on said sole holder. The design and adjustability of the sole holder components 24 and 25 as shown in FIGS. 13 and 14, naturally can be employed also with the embodiment according to FIGS. 11 and 12, so that the latter two figures are described jointly for that reason.

In both exemplified embodiments, the spherical hub 28 is stationarily arranged on the bearing block 14, and the sole holder 8 with the sole holder components 24 and 25 revolves around the ball-and-socket joint 26 about the vertical axis 56 and about the transverse axis 51, as it has been described in detail above with the help of FIGS. 2 to 8.

The sole holder again may be comprised of a number of components, so that the sole holder components 24 and 25 adjustably secured on the center part 74 can be adjusted with respect to their angular positions in relation to the longitudinal axis 17 for adjusting the opening angle 44, as well as with respect to their vertical spacing from the top side 42 of the sports equipment 3. For fixing the vertical spacing 41, it is naturally not necessary to use the spacing in relation to the top side 42 of the sports device 3, but rather any desired spacing can be used, e.g. the spacing from the stand-on surface for the boot 2.

Now, a central release device is arranged for controlling the uncoupling movement around the vertical axis 56 in both directions along the transverse axis 51, whereby in the present exemplified embodiment shown in FIGS. 11, 12, 13, the pre-tensioning spring 10 associated with the release device 12 can be stationarily supported in its center area, for example on or in the housing part mounted fixed on the top side 42 of the sports equipment 3.

However, it is also possible to make provision that two separate pre-tensioning springs 46 are supported on the opposite side on a stationary structural component, or on the bearing block 14, when the sole holder 8 is moving in one direction, so that the entire length of the respective pre-tensioning spring 46 can be exploited for damping purposes or for adjusting the uncoupling characteristics.

A support arm 75 projecting against the sole holder 8 is protruding between the two separate pre-tensioning springs 46, which are arranged one for each uncoupling direction, and which may be joined with the sole holder 8, forming one single piece with the latter, or connected with said sole holder via suitable connecting or coupling elements.

The support arm 75 is preferably arranged on an uncoupling axis 76 extending through the center 34 of the ball-and-socket joint 26, or of the spherical hub 28 or the joint socket 29, whereby the pivotal movement of the sole holder 8 around the transverse axis 51 is neither inhibited nor limited in any way.

However, it is naturally possible also to arrange the uncoupling axis 76 parallel to the longitudinal axis 17, or slanted to a minor degree relative to the latter at an angle of from 2° to 20°, preferably 5° to 15°, preferably ascending from the end of the toe binding fixture 5 facing away from the sole holder 8, in the direction of the latter. In the last-mentioned case, it may be necessary for fixing the uncoupling values for backwards uncoupling, thus when the sole holder 8 is pivoting around the transverse axis 51, to include in the determination of said values the uncoupling characteristics or deformation of the pre-tensioning springs 10 and 46 of the release device 12.

Furthermore, it is shown in connection with FIGS. 11 to 15 that the spherical hub 28 is joined in a fixed way with the bearing block 14 or housing of the toe binding fixture 5. The joint socket is accordingly arranged in the sole holder 8 or central part 74 of the latter, with its inside diameter corresponding as exactly as possible with the outside diameter of the spherical segment of the spherical hub. The joint socket 29 may be formed exactly as shown in the present exemplified embodiment according to FIGS. 14 and 15. For said purpose, the central part 74 again consists of the two joint socket components 30 and 31, which, as already described in detail with the help of FIGS. 2 to 8, are connected via the connecting means 35, which are screws in the present case.

However, as opposed to the embodiments described heretofore, the joint socket 29 is a component of the sole holder 8 and adjustable relative to the bearing block 14 or the housing of the toe binding fixture 5.

For limiting and/or releasing the sole holder 8 in or for its revolution around the transverse axis 51, provision is again made for an uncoupling device 52, which centrally protrudes from a support arm 77, in the present case from the joint socket component 31 beyond the direction opposing the stand-on surface, supporting itself with its spring 60. As already explained in connection with the exemplified embodiments described above, the initial tension of the spring 60 can be centrally adjusted for the entire sole holder with an adjustment element, e.g. a spring.

As shown more clearly in FIG. 14, for adjusting the vertical spacing 41, provision is made for the adjustment elements 78, which, in the form of suitable adjustment elements already known in the prior art, can be used for changing the opening angle 44.

The embodiment according to FIGS. 13 and 14 differs from the one according to FIGS. 11 and 12 in that instead of employing two actuation levers opposing each other on the one and other side of the joint socket component 31, use is made of only one single release device 12 serving the entire sole holder 8. Said release device comprises a pre-tensioning spring 10 arranged concentrically with the longitudinal axis 17, or parallel to the latter, whereby said spring can be initially tensioned via an adjustment screw for changing the uncoupling characteristics. Via a ball 79, which is provided in a spherical ball track 80 on the side of the joint socket component 31 averted from the sole holder 8, it is possible to adjust the uncoupling characteristics of the toe binding fixture 5 for so-called "rotational falls", i.e. in connection with which the sole holder is swiveled around the ball-and-socket joint 26. Since suitable designs and monitoring and controlling devices are known from the prior art for such purposes in a variety of different embodiments, such known systems can be employed for the present purpose as well. It is advantageous in this conjunction if the pre-tensioning spring is arranged on an axis extending parallel to the longitudinal axis and through the center 33 of the spherical hub 28. This will hardly influence the uncoupling characteristics of the sole holder 8 with respect to the uncoupling device 52.

Figure 15:
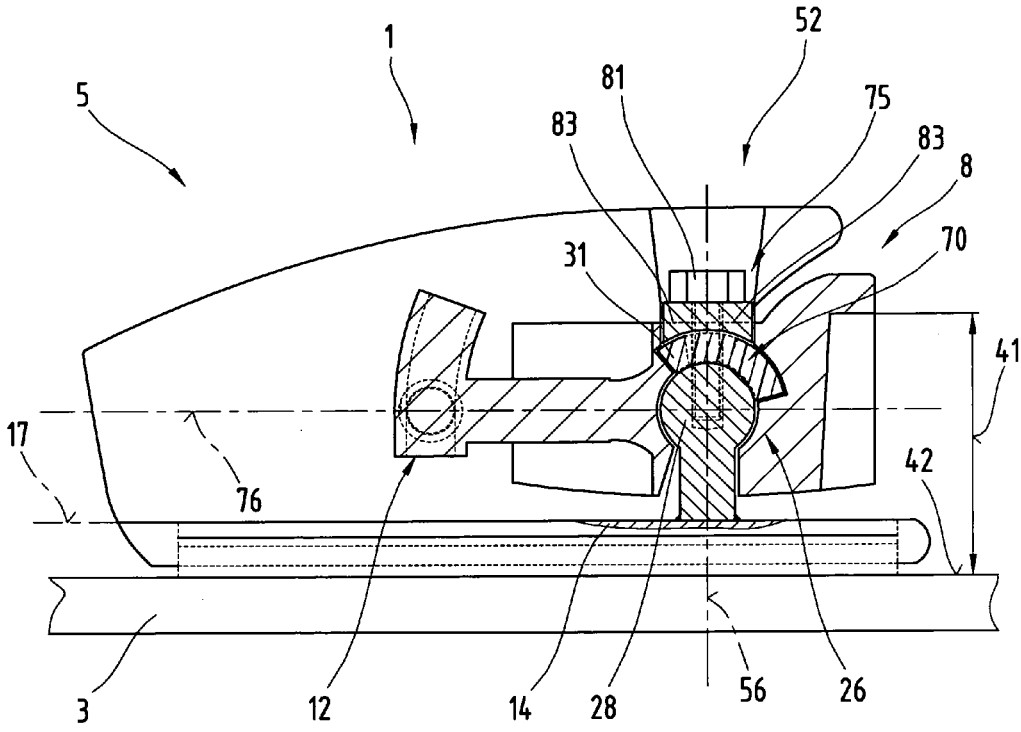
FIG. 15 is a partly sectional side view and simplified representation of another embodiment of the bearing of the spherical hub in the joint socket, as well as of the uncoupling device.
Figure 16:
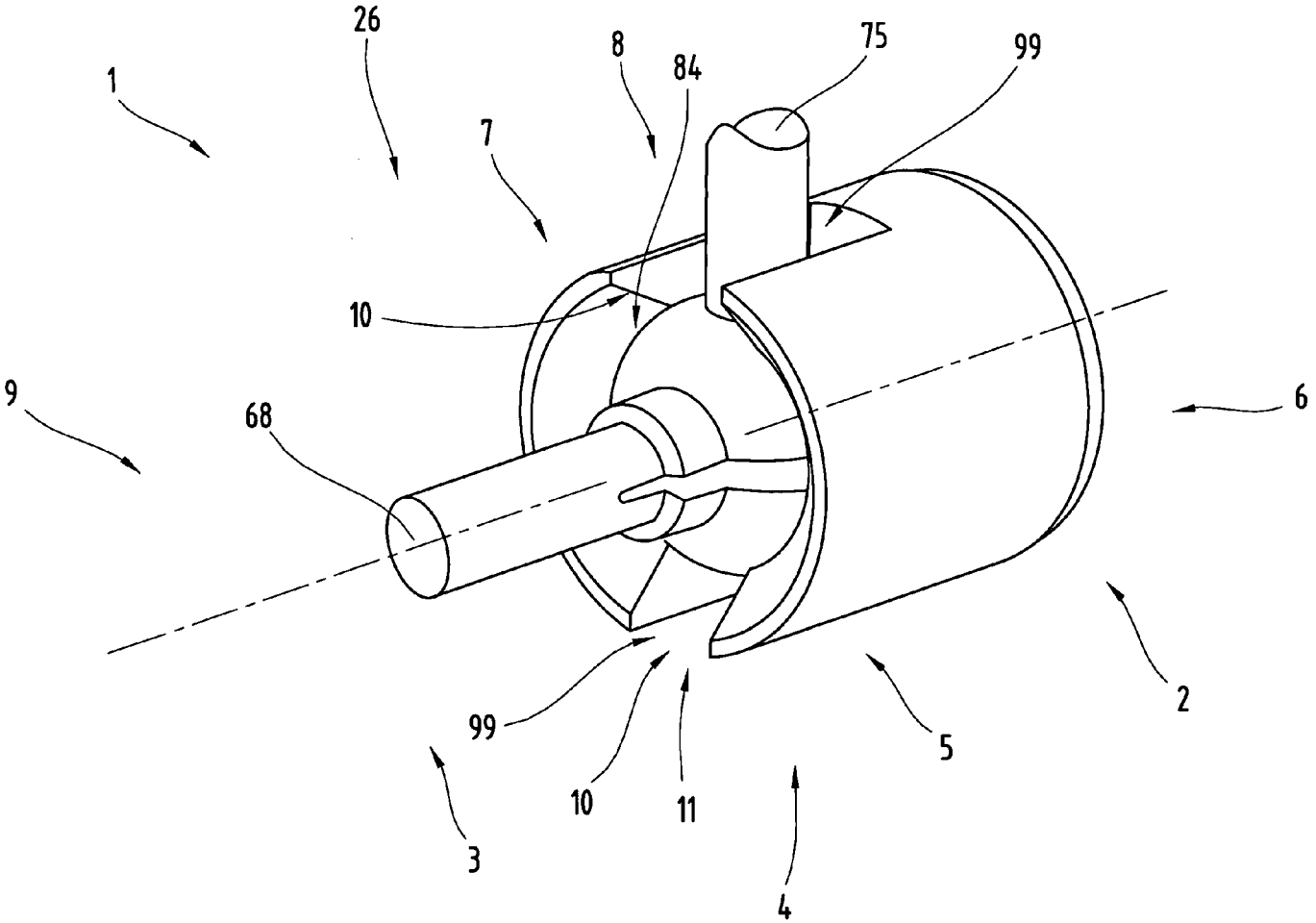
FIG. 16 is a perspective view and simplified representation of a design variation of a ball-and-socket joint.

The embodiment shown in FIG. 15 is different from the embodiments according to FIGS. 11 to 14 only in that it shows another design variation of the uncoupling device 52 in a form that can be used in conjunction with the exemplified embodiment according to FIGS. 9 and 10.

In the present embodiment, the support arm 75 is a fastening means 81, e.g. a screw, which is inserted in a bore of the spherical hub 28. The spherical hub connected with the sole holder 8 or a sole holder component 24, 25, is rotatable vis-à-vis the stationary joint socket components 30, 31, In one of the two stationary joint socket components 30, 31, provision is made for a slot-like breakthrough 70, which also may have a defined curved shape, through which the support arm 75 is projecting.

Furthermore, the damping elements 83 are arranged on said stationary joint socket component 31, surrounding the fastening means 81, whereby such damping elements may have varying characteristics of elasticity in different three-dimensional directions, if deemed desirable. Said damping elements, furthermore, also may be components made of a uniform, automatically elastically rebounding material consisting of plastic and/or rubber, or may be some other suitable spring constructions.

For example, it is possible to fix the spherical hub 28 in the joint socket 29 via a snap bead 84, for which purpose the joint socket 28 is formed narrowed by the snap bead 84.

Figure 17:
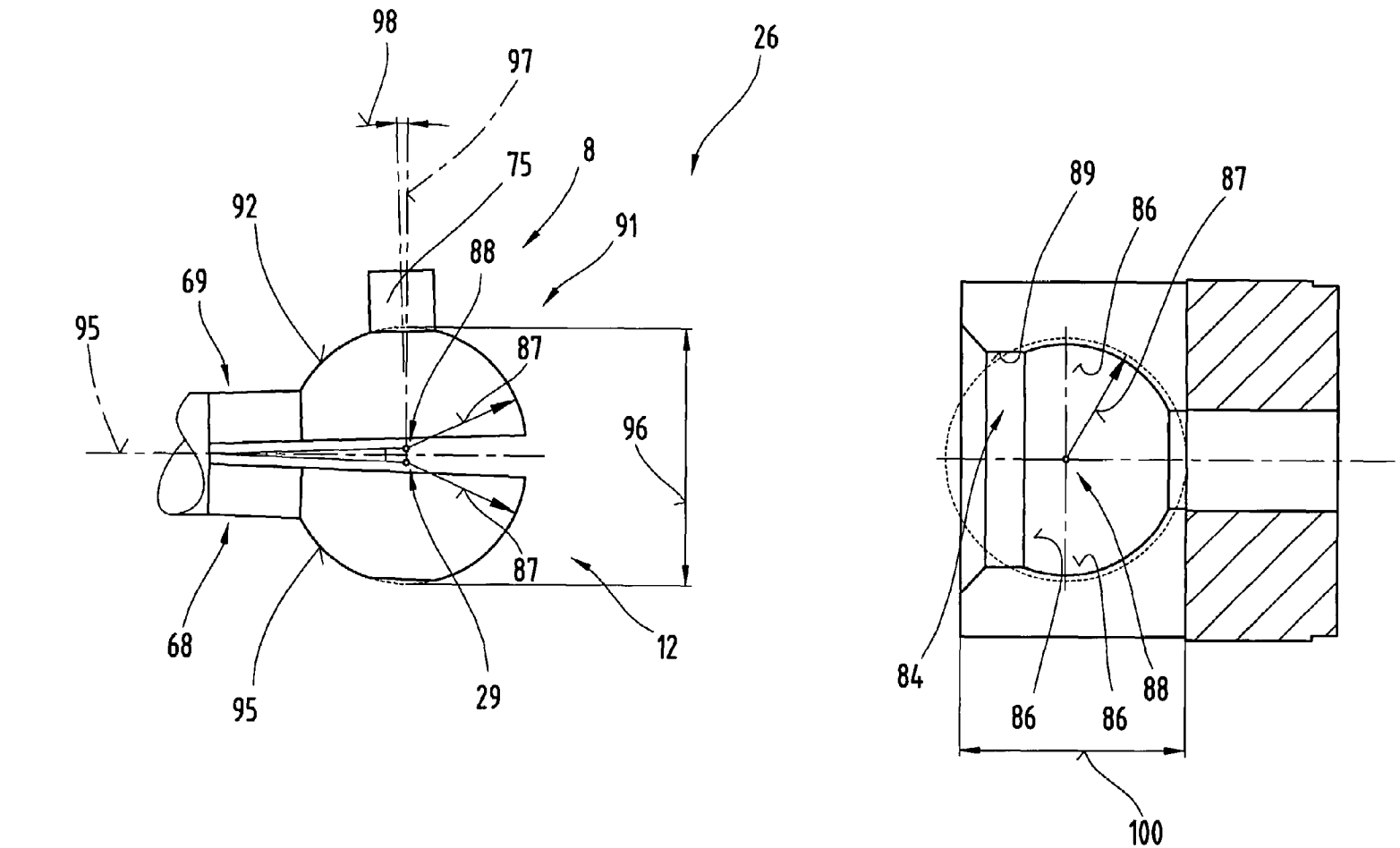
FIG. 17 is an exploded and partly sectional view and simplified representation of the ball-and-socket joint according to FIG. 16.
Figure 18:
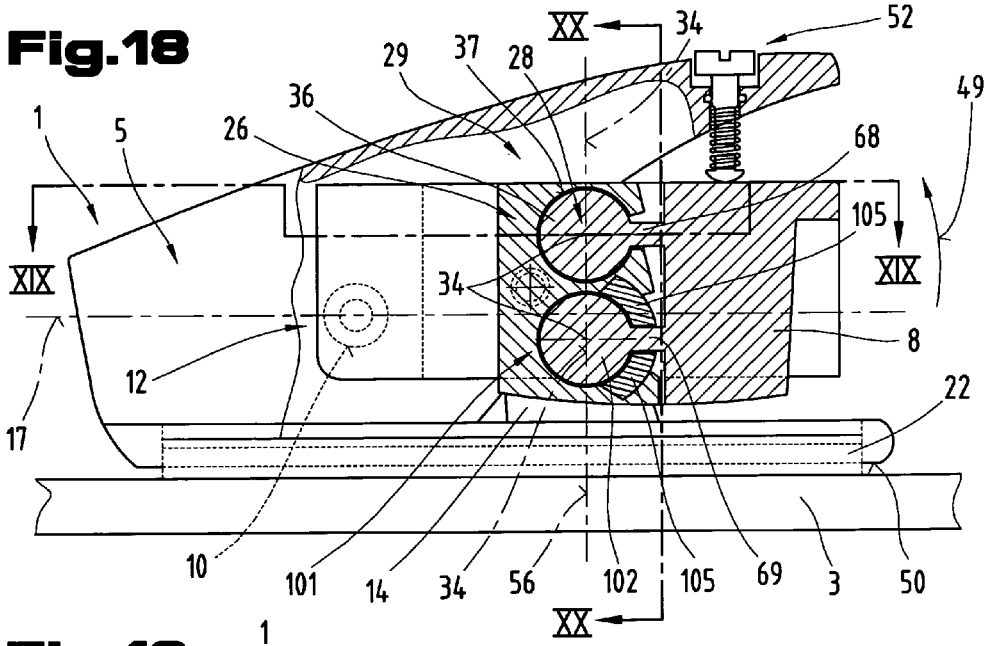
FIG. 18 is a sectional side view of a further design of the toe binding fixture of the connecting device as defined by the invention, comprising two ball-and-socket joint arranged one on top of the other, with a section along lines XVIII-XVIII in FIG. 19.

What is achieved with such a snap bead 84 is that the spherical hub 28 inserted in the joint socket 29 can be released from the operating position only through application of a force directed parallel to the spherical track 80. In the embodiment according to FIG. 17, the inner surface 86 of the joint socket 29 is formed by parts of the spherical surface 86 with a spherical radius 87. The parts of the spherical surface 86 have a common center 88, in which the spherical arm 68 is disposed. The snap bead 84 of the joint socket 29, which is oriented in the direction of the spherical arm 68, is designed in such a way that the inner surface 89 of the snap bead 84 and the inner surface 86 of the joint socket 29 jointly form a common spherical surface 86 at least by sections.

The spherical hub 28 is comprised of the two spherical segments 90 and 91, which each are connected with a sole holding component 24 and 25, respectively. The two spherical arms 68 and 69 are spring-elastically deformable, so that the relative position of the two spherical segments 90 and 91, respectively, can be changed through application of force. The two spherical segments 90 and 91 have the outer surfaces 92 and 93, respectively, which are formed by parts of spherical surfaces. The spherical surfaces have a spherical radius 87 with the centers 88 and 33 respectively. The center 88 and also the center 33 each are distanced by a spacing 94 from the rotational axis 95 of the spherical arm 68 in the direction of the associated spherical segments 90 and 91, respectively. The spherical radius 87 of the spherical hub 28 has a value equal to or only slightly lower than the value of the spherical radius 87 of the joint socket 29. Owing to the fact that the two spherical segments 90 and 91 are distanced from each other in the direction perpendicularly to the axis of rotation 95 of the spherical arm 68, what is achieved in this way is that the largest spacing 96 of points of the spherical surfaces 92 and 93 amounts to more than twice the amount of the spherical radius 87 of the joint socket 29. The embodiment of the spherical hub 28 or arrangement of the spherical segments 90 and 91 as a whole is designed in such a way that the two spherical segments 90 and 91 are pressed against each other only once the spherical hub 28 is inserted in the joint socket 29, so that the centers 88 coincide in a common point. For achieving this, the spherical arms 68 and 69 first have to be deformed to an extent such that the snap bead 86 is overcome, and the spherical hub 28 is finally locked into its intended operating position in the joint socket 29. In said locked position, the spherical arms 68 and 69 remain elastically deformed, so that the spherical surfaces 92 and 93 of the spherical segments are maintained pressed against the inner surface 86 or spherical surface 86 of the joint socket 29.

The two spherical segments 90 and 91 of the spherical hub 28 are, as a whole, formed in such a way that the external operating shape of the spherical hub 28 is reached only once it has been locked in the joint socket 29. For said purpose, at least one support arm 75 that is to be received in the breakthrough 70, can be arranged on the spherical segments 90 and 91 in such a way that in the non-inserted condition in the joint sockets 29, the axis 97 in each case encloses an angle of inclination 98 with a plane perpendicular to the rotational axis 95, whereby the pivotal axes 97 are inclined in the direction of the respective spherical arms 68 and 69. Such an inclined arrangement of the pivotal axes 97 with an angle of inclination 98 corresponds with an inclination of the spherical arms 68 and 69 that can be expressed or described as being the spherical arm angle. Such a spherical arm angle approximately corresponds with the ratio between the spacing of the centers 88 of the two spherical segments 90 and 91 from the rotational axis 95, and the spacing of said centers 88 from the ends of the spherical arms 68 and 69. Provision is made in this connection that the angle of inclination 98 of the pivotal axis is larger than the spherical arm angle. What can be achieved in this way is that in the condition in which the spherical arms are inserted in the joint socket 29, the pivotal axes 97 are aligned parallel to or coaxially with said spherical arms, and are not inclined vis-à-vis the plane extending perpendicularly to the axis of rotation 95. Thus the pivotal axes are disposed in one plane. The angle of inclination 98 preferably has a value in the range of 1° and 4°, preferably 2°.

It is possible also to provide the joint socket 29 with the grooves 99 extending in radial planes, such grooves extending at least over part of the height 100 of the spherical indentation segment 37.

Said height 100 of the spherical indentation segment 37 is preferably larger than the radius of the spherical hub 28, but smaller than the diameter of said spherical hub. If the groove 99 is extending over part of the height 100, it is necessary to take into account that the bridge remaining between the individual grooves 99 has to ensure adequate strength of the joint socket 29. In most cases, the groove will extend only over the height of the spherical indentation segment 37, which only partly projects beyond the center 34 of the spherical indentation segment or spherical segment, and over part of the radius in the opposite direction only if necessary.

By arranging one or more of such grooves 99 it is possible to widen the spherical indentation segment to a larger diameter when it is mounted on the spherical hub, in order to rebound thereafter into the original starting position, so that the spherical indentation segment embraces the spherical hub or snaps over the latter.

In order to permit such an embodiment to be realized, it is necessary for the expert skilled in the present technical field to select the materials to be used in the production from metals or plastics in such a way that the deformation of the spherical indentation segment will be limited in such a way that such materials will automatically elastically rebound for retaining the spherical indentation segment on the spherical segment.

The manufacture of divided spherical indentation segments or joint sockets 29 can be avoided in this way.

On the other hand, it is naturally possible also to produce rigid, one-component joint sockets 29, and to provide the spherical segments of the spherical hub with suitable cuts or grooves, so that the outside diameter of the spherical segment, when passing through the opening of the spherical indentation segment with a diameter smaller than the one of the spherical segment, is compressed in such a way that the spherical segment snaps into the spherical indentation segment, and is automatically locked in the latter by automatic elastic rebounding of the material of the spherical segment. The expert in this field is familiar with the manufacture of such divided spherical segments or balls, which can be produced by known manufacturing methods from known materials.

Figure 19:
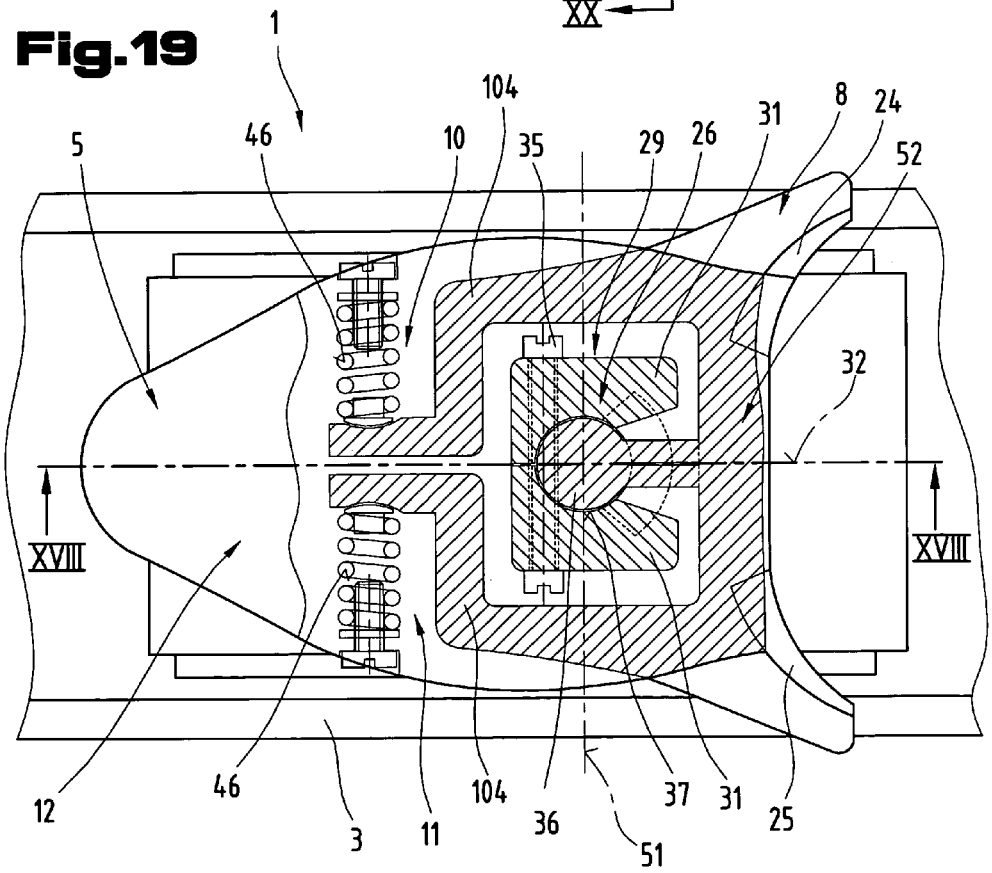
FIG. 19 is a sectional top view of the toe binding fixture according to FIG. 18, with a section according to lines XIX-XIX in FIG. 18.
Figure 20:
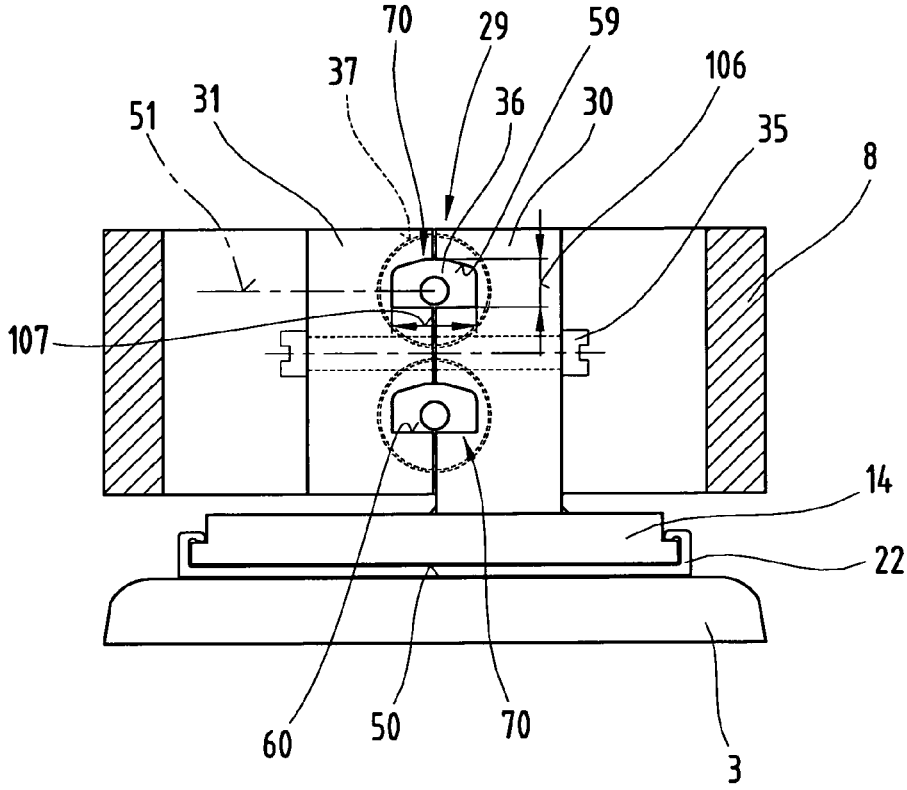
FIG. 20 is a sectional front view of the toe binding fixture according to FIGS. 18 and 19 with a section according to lines XX-XX in FIG. 18.

FIGS. 19 to 20 show of a further exemplified embodiment of the connecting device 1 within the area of the toe binding fixture 5. In the present embodiment, which substantially corresponds with the exemplified embodiment according to FIGS. 3 to 6 with respect to the release devices 11 and 12 and the design of the uncoupling device 52, two ball-and-socket joints 26 and 101 are arranged one on top of the other along the vertical axis 56. Since the release device 12 and the uncoupling device 52 are designed identically, the contents of the descriptions of said FIGS. 3 to 6 are hereby made the object of the description of the present exemplified embodiment, and the same reference numbers are used for identical components as well.

In the present exemplified embodiment, the joint socket 29 is comprised of two components and consists of a joint socket component 30 and a joint socket component 31. The separation plane 32 extends perpendicularly to the support surface 50 and parallel to the longitudinal axis 17. The joint socket component 30 is connected in a fixed manner with the bearing block 14, and the joint socket component 31 is secured on said bearing block via the connecting means 31, and projects from the bearing block, so that the two spherical segments 36 and 102 can be inserted in the components of the joint socket 29 arranged in the stationary joint socket component 31 first, whereupon the second joint socket component 30 is then connected with the stationary joint socket component 31 via the connecting means 35, so that the spherical segments 36 and 102 are subsequently positioned and fixed in the joint socket 29 in this way.

Each of the two spherical hubs 28 or of their spherical segments 36 and 102 are connected via the spherical arms 68 and 69, respectively, with the sole holder 8, which is realized in the form of one single piece in the present exemplified embodiment. It is naturally possible also to realize the sole holder according to other exemplified embodiments, particularly also in accordance with the embodiment shown in FIGS. 13 and 14.

For fixing the uncoupling characteristics, the release device 12 with the two pre-tensioning springs 46 is arranged distanced from the ball-and-socket joint or the contact surface between the spherical segment 36 and the spherical indentation segment 37, or the spherical segment 102 and the spherical indentation segment 103 associated with said spherical segment 102. For this purpose, the sole holder 8 is equipped with the two holding arms 104 embracing the ball-and-socket joints 26 and 101, whereby said holding arms are supported on the pre-tensioning springs 46 in the end areas facing away from the sole holder components 24 and 25. The vertical guidance of the sole holder 8 is assured by the ball-and-socket joints 26 and 101 arranged one on top of the other. Owing to the fact that the centers 33 of the two ball-and-socket joints are concentrically arranged on the vertical axis 56 or on an axis extending parallel to said vertical axis, free lateral mobility of the sole holder 8 around said vertical axis is made possible as well.

Now, in order to allow the sole holder 8 in such an embodiment to pivot around a transverse axis 51 (FIG. 19), said transverse axis extending in the present exemplified embodiment through the center 33 of the spherical hub 28 of the ball-and-socket joint 26, one or more damping elements 105, for example, are arranged in a part of the joint socket for the ball-and-socket joint 101. As long as the sole holder pivots about a plane substantially extending parallel to the support surface 50, such pivotal movement is influenced only by the pre-tensioning spring of the release device 12.

However, if the sole holder is stressed in the direction of the sports device 3, i.e., loaded in such a way that would cause the sole holder to pivot along the line of arrow 49, such a pivotal movement is dampened provided that provision has been made for such damping elements 105 consisting of, for example an elastically and automatically rebounding elastomeric material made of plastic and/or rubber. Depending on the characteristics of elasticity of said damping element 105, it is possible also that if the sole holder is expected to be subjected to very high stress, to compress such damping material by means of the spherical arm 69 in the direction of the arrow 49 to such a degree that a pivotal angle will be reached permitting the toe part of the boot to move away from the sports equipment 3. However, instead of using such a damping element, or in addition to the latter, it is possible also to make provision for an uncoupling device 52 that will control the damping and uncoupling movement of the sole holder 8 via a preadjustable spring or the characteristics of the latter, if pivotal movements around the transverse axis should occur as indicated by arrow 49.

The freedom of movement of the spherical arms 68 and 69 is fixed in this connection according to the damping and deflection distances limiting the maximum movement of the sole holder 8 as the latter is swiveling around both the vertical axis 56 and the transverse axis 51. Depending on the free space desired for such pivotal movements, the height 106 or the width 107 of the curve of the peripheral line of the breakthrough can be freely aligned in all three three-dimensional directions in order to limit, for example pivoting of the toe binding fixture around the transverse axis 51 as the deflective movement around the vertical axis 56 is increasing, or vice versa. Said course of the curve for guiding the spherical arms 68 and 69 has to be fixed by the expert engaged in the present field in accordance with the requirements and basic laws of kinematics with the help of calculations or tests, so that, therefore, no detailed explanations are required. Important is that the height 106 of the breakthroughs 70 at least has to be dimensioned sufficiently large that the sole holder 8 is capable of pivoting upwards from the holding position 54 drawn by full lines, where the point of the boot or the boot 2 is held, to such an extent that the tip of the boot, or the edge of the boot 2 embraced by the sole holder 8 is released, and thus capable of detaching itself from the connecting device 1.

Instead of using the damping elements 105, it is of course possible also that for limiting the rotational movement around the center 33 of the ball-and-socket joint 26, a component of the joint socket associated with the ball-and-socket joint 101 can be pressed into the remaining part of the joint socket 29 or joint socket component 30 or 31 via a pre-tensioning element with a preferably pre-adjustable initial tensioning force.

The exemplified embodiments show feasible design variations of the connecting device, whereby it is noted herewith that the invention is not limited to the design variations specifically shown, but that various combinations of the individual design variations among one another are rather realizable as well, and that based on the instructions for technical execution imparted by the present invention, such variation possibilities fall within the scope of the professional skill of the expert engaged in the present technical field. Furthermore, all conceivable design variations feasible by combining individual details of the design variations shown and described herein are jointly covered by the scope of protection.

The problems on which the independent inventive solutions are based are disclosed in the specification. Most of all, the individual embodiments shown by way of example in FIGS. 1, 2, 3, 4, 5, 6, 7, 8; 9, 10; 11, 12; 13, 14; 15; 16, 17; 18, 19, 20, may form the object of independent solutions as defined by the invention. The relevant problems and solutions as defined by the invention can be taken from the detailed descriptions of said figures.

| List of Reference Numbers | |
|---|---|
| 1 | Connecting device |
| 2 | Boot |
| 3 | Sports equipment or device |
| 4 | Tip of boot |
| 5 | Toe binding fixture |
| 6 | Heel area |
| 7 | Heel binding fixture |
| 8 | Sole holder |
| 9 | Sole holder |
| 10 | Tension spring |
| 11 | Tension spring |
| 12 | Release device |
| 13 | Release device |
| 14 | Bearing block |
| 15 | Bearing block |
| 16 | Binding support plate |
| 17 | Longitudinal axis |
| 18 | Adjustment screw |
| 19 | Extending spring |
| 20 | Abutment |
| 21 | Coil spring |
| 22 | Longitudinal guide |
| 23 | Adjustment screw |
| 24 | Sole holder component |
| 25 | Sole holder component |
| 26 | Ball-and-socket joint |
| 27 | Ball-and-socket joint |
| 28 | Spherical hub |
| 29 | Joint socket |
| 30 | Joint socket component |
| 31 | Joint socket component |
| 32 | Separation plane |
| 33 | Center |
| 34 | Diameter |
| 35 | Connecting means |
| 36 | Spherical segment |
| 37 | Spherical indentation segment |
| 38 | Opening angle |
| 39 | Guide arrangement |
| 40 | Fixing means |
| 41 | Vertical spacing |
| 42 | Top side |
| 43 | Sole protrusion |
| 44 | Opening angle |
| 45 | Counter-holding component |

-continued

| List of Reference Numbers | |
|---|---|
| 46 | Tension spring |
| 47 | Sliding element |
| 48 | Guide track |
| 49 | Arrow |
| 50 | Support surface |
| 51 | Transverse axis |
| 52 | Uncoupling device |
| 53 | Uncoupling device |
| 54 | Holding position |
| 55 | Uncoupling position |
| 56 | Vertical axis |
| 57 | Indicating element |
| 58 | Indicator |
| 59 | Damping element |
| 60 | Spring |
| 61 | Adjustment element |
| 62 | Stop |
| 63 | Adjustment screw |
| 64 | Plane |
| 65 | Guide track |
| 66 | Guide track |
| 67 | Diameter |
| 68 | Spherical arm |
| 69 | Spherical arm |
| 70 | Breakthrough |
| 71 | Width |
| 72 | Diameter |
| 73 | Opening angle |
| 74 | Central part |
| 75 | Support arm |
| 76 | Uncoupling axis |
| 77 | Support arm |
| 78 | Adjustment element |
| 79 | Ball |
| 80 | Spherical track |
| 81 | Fastening means |
| 82 | Sliding block |
| 83 | Damping element |
| 84 | Surface |
| 85 | Axis of rotation |
| 86 | Snap bead |
| 87 | Spherical radius |
| 88 | Center |
| 89 | Surface |
| 90 | Spherical segment |
| 91 | Spherical segment |
| 92 | Surface |
| 93 | Surface |
| 94 | Spacing |
| 95 | Axis of rotation |
| 96 | Spacing |
| 97 | Pivotal axis |
| 98 | Angle of inclination |
| 99 | Groove |
| 100 | Height |
| 101 | Ball-and-socket joint |
| 102 | Spherical segment |
| 103 | Spherical indentation segment |
| 104 | Holding arm |
| 105 | Damping element |
| 106 | Height |
| 107 | Width |

What is claimed is:

1. A connecting device between a boot and a board-like type of sports equipment, comprising a toe or front binding fixture associable with the tip of the boot, and a heel or rear binding fixture associable with the heel area of the boot, each of said binding fixtures having a sole holder adapted for engaging the boot, between which the boot is clamping with a pre-tensioning force, such force being applicable via a tension spring; a release device for the sole holder arranged between the sole holder and the bearing block of the toe and heel binding fixtures, said bearing block being arranged fixed on the ski; and with a joint arrangement arranged between the sole holder and the bearing block fixed on the ski for rotationally supporting said sole holders relative to one another in at least two three-dimensional directions extending perpendicularly to one another, whereof one of said directions is aligned vertically relative to a support surface of the bearing block for supporting the latter on the board-like type of sports equipment, wherein a joint arrangement is formed by at least one ball-and-socket joint arranged between the bearing block and the sole holder or at least one sole holder component.

2. The connecting device according to claim 1, wherein the release device is arranged outside of the interior space of a joint socket receiving a spherical segment.

3. The connecting device according to claim 1, wherein the sole holder and/or at least one sole holder component are adapted for pivoting relative to the bearing block around a transverse axis extending parallel to the support surface and perpendicularly to a longitudinal axis.

4. The connecting device according to claim 1, wherein a further uncoupling device is arranged between the joint components of the ball-and-socket joint movable relative to one another for positioning, damping and/or releasing the pivotal movement of the sole holder and/or at least one sole holder component around the transverse axis.

5. The connecting device according to claim 1, wherein the release device forms at the same time the uncoupling device for the sole holder and/or at least one sole holder component.

6. The connecting device according to claim 1, wherein a ball-and-socket joint is associated with each of the two sole holder components on each of the two sides of the longitudinal axis of the connecting device.

7. The connecting device according to claim 1, wherein the centers of the spherical segments associated with the two sole holder components of the ball-and-socket joint are arranged on a transverse axis.

8. The connecting device according to claim 1, wherein the sole holders or sole holder components are connected with the spherical segments of the ball-and-socket joints via spherical arms.

9. The connecting device according to claim 1, wherein a guide arrangement with a fixing means is arranged between the spherical arms of the ball-and-socket joints and the sole holder or the sole holder components, and the sole holders or sole holder components are adjustable and fixable relative to the spherical segments in the longitudinal direction of the vertical axis via said guiding arrangement.

10. The connecting device according to claim 1, wherein a guiding arrangement with a fixing means is arranged between the spherical arms of the ball-and-socket joints and the sole holders or sole holder components, and the sole holder or the sole holder components are pivotable and fixable relative to the spherical segments around the vertical axis via said guiding arrangement.

11. The connecting device according to claim 1, wherein the release device or its pre-tensioning spring is arranged outside of an axis extending through the center of the spherical segments on the axis extending toward the longitudinal axis in the direction of the protruding sole holder component.

12. The connecting device according to claim 1, wherein the release device or its pre-tensioning spring is arranged extending at an angle in relation to the longitudinal axis.

13. The connecting device according to claim 1, wherein the release device or its pre-tensioning spring is arranged extending concentrically with and parallel to the longitudinal axis and through the center of the ball-and-socket joint associated with the respective sole holder component.

14. The connecting device according to claim 1, wherein the release devices for the sole holder are arranged on support arms extending from the ball-and-socket joints in the direction opposing the support surfaces of the sole holders for supporting the boot.

15. The connecting device according to claim 1, wherein the release devices for the sole holders are aligned parallel to the transverse axis, and the pre-tensioning springs are supported with their ends facing one another on a holding arm extending between said ends along the longitudinal axis extending in the center of the connecting device, said holding arm being connected with the joint socket.

16. The connecting device according to claim 1, wherein a pre-tensioning spring of the release device is arranged spaced from a support surface of the connecting device with a larger spacing than an axis extending through the center of the spherical hub of the ball-and-socket joints parallel to the longitudinal axis.

17. The connecting device according to claim 1, wherein a pre-tensioning spring of the release devices is concentrically arranged on an axis extending parallel to the longitudinal axis through the center of the spherical hub of the ball-and-socket joints.

18. The connecting device according to claim 1, wherein the release device or its pre-tensioning spring is supported on the sole holder or sole holder component via a sliding element.

19. The connecting device according to claim 1, wherein the sliding element of the release devices is supported in a sliding or guiding track extending approximately parallel to the vertical axis.

20. The connecting device according to claim 1, wherein the sliding element is a rolling body, for example a ball or a roll.

21. The connecting device according to claim 1, wherein the joint socket is comprised of several joint socket components.

22. The connecting device according to claim 1, wherein a separation plane of the joint socket is arranged in a vertical plane extending parallel to the longitudinal axis.

23. The connecting device according to claim 1, wherein a separation plane of the joint socket is arranged on a plane extending parallel to the transverse axis.

24. The connecting device according to claim 1, wherein the separation plane of the joint socket is arranged on a plane extending parallel to the support surface.

25. The connecting device according to claim 1, wherein the joint socket components are connected with one another via connection means.

26. The connecting device according to claim 1, wherein the sole holder is pivotably guided via a guide track around the ball-and-socket joint on a plane extending parallel to the support surface.

27. The connecting device according to claim 1, wherein one of the joint components of the ball-and-socket joint is formed by a spherical hub, and the other joint component by a joint socket, one of said two components being stationarily connected with the bearing block fixed on the ski.

28. The connecting device according to claim 1, wherein the spherical hub is formed by a spherical segment having a height larger than the spherical radius and smaller than the diameter of the spherical segment.

29. The connecting device according to claim 1, wherein the joint socket is formed by a spherical indentation segment having a height larger than the spherical radius, but smaller than the height of the spherical segment of the spherical hub.

30. The connecting device according to claim 1, wherein the spherical radius of the spherical hub is smaller than the spherical radius of the spherical indentation segment.

31. The connecting device according to claim 1, wherein the spherical hub is divided in several sectors by at least one radial groove extending at least over a part of the height of the spherical segment.

32. The connecting device according to claim 1, wherein at least one sole holder component is adjustable and fixable versus a central part of the sole holder provided with the spherical hub or joint socket, in the direction extending perpendicularly to the support surface.

33. The connecting device according to claim 1, wherein at least one sole holder component is pivotable and/or adjustable and fixable vis-à-vis the central part of the sole holder provided with the spherical hub or joint socket, around an axis extending perpendicularly to the support surface.

34. The connecting device according to claim 1, wherein the uncoupling device is associated with each of the sole holder components of the sole holder.

35. The connecting device according to claim 1, wherein the uncoupling device is supported on the side of the sole holder or a sole holder component facing away from the support surface, and aligned parallel to the vertical axis.

36. The connecting device according to claim 1, wherein the uncoupling device comprises a damping element and/or a spring, the damping or uncoupling characteristics of said damping element and/or spring being adjustable via an adjustment element.

37. The connecting device according to claim 1, wherein the uncoupling device and/or its spring are aligned approximately parallel to the longitudinal axis of the connecting device, and supported within the area of the longitudinal center axis of the connecting device on the sole holder or sole holder component or a central part of the sole holder via a support arm.

38. The connecting device according to claim 1, wherein the guide track is formed by a further ball-and-socket joint, and the spherical centers of the spherical hubs of the two ball-and-socket joints are arranged on a pivotal axis extending perpendicularly to the support surface.

39. The connecting means according to claim 1, wherein the pivotal axis of the two ball-and-socket joints is inclined by from 0.01° to 20°, preferably from 5° to 10°, vis-a-vis the direction extending perpendicularly to the stand-on surface opposing the boot support surface on the sole holder.

40. The connecting device according to claim 1, wherein the joint sockets of the two ball-and-socket joints are formed by the joint socket components, and a separation plane of the joint socket components extends through the centers of the two spherical indentation segments or spherical segments of the spherical hubs, said joint socket components being rigidly joined with the sole holder via a hub stub.

41. The connecting device according to claim 1, wherein the joint sockets are provided with a guide track for guiding the spherical arm, specifically with a breakthrough, and a part of the circumference of the breakthrough forms the track for guiding the sole holder.

42. The connecting device according to claim 1, wherein a part of the joint socket arranged on the plane penetrating the center of the spherical hub in the direction of the hub stub is adjustable in the direction of the latter.

43. The connecting device according to claim 1, wherein the joint socket component is pressed against the remaining part of the joint socket via a pre-tensioning element with a preferably adjustable pre-tensioning force.

44. The connecting device according to claim 1, wherein a damping element, particularly an elastic, automatically rebounding damping element made of rubber and/or plastic is arranged between the adjustable joint socket component and the spherical hub.

* * * * *